US006851778B2

(12) United States Patent
Okuda

(10) Patent No.: US 6,851,778 B2
(45) Date of Patent: Feb. 8, 2005

(54) DROPLET EJECTING HEAD, METHOD FOR DRIVING THE SAME, AND DROPLET EJECTING APPARATUS

(75) Inventor: Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 241 days.

(21) Appl. No.: 10/308,129

(22) Filed: Dec. 3, 2002

(65) Prior Publication Data

US 2003/0122889 A1 Jul. 3, 2003

(30) Foreign Application Priority Data

Dec. 3, 2001 (JP) ..... P2001-369133

(51) Int. Cl.[7] ..... B41J 29/38
(52) U.S. Cl. ..... 347/10; 347/47
(58) Field of Search ..... 347/10, 11, 47

(56) References Cited

U.S. PATENT DOCUMENTS 5,757,391 A * 5/1998 Hoisington ..... 347/11

FOREIGN PATENT DOCUMENTS

| | | |
|---|---|---|
| JP | 53-12138 | 4/1978 |
| JP | 55-17589 | 2/1980 |
| JP | 10-193587 | 7/1998 |
| JP | 2000-117969 | 4/2000 |
| JP | 2000-218778 | 8/2000 |
| JP | 2001-63042 | 3/2001 |
| JP | 2001-328259 | 11/2001 |

* cited by examiner

*Primary Examiner*—Lamson Nguyen
*Assistant Examiner*—Blaise Mouttet
(74) *Attorney, Agent, or Firm*—Morgan, Lewis & Bockius LLP

(57) ABSTRACT

A nozzle for ejecting a droplet has a straight portion having a substantially straight shape. A driving waveform to be applied to a piezoelectric actuator includes a first voltage change process for expanding volume of a pressure generating chamber to retract a meniscus of the nozzle portion toward the pressure generating chamber and a second voltage change process for compressing the volume of the pressure generating chamber to eject a droplet. Voltage change quantity and voltage change time of the first voltage change process are set so that meniscus retraction quantity D when the second voltage change process is applied satisfies $0.8 \cdot l_n \leqq D \leqq 1.5 \cdot l_n$ ($l_n$ designates length of the straight portion of the nozzle). Consequently, when the second voltage change process is applied, strong liquid surface interference can be produced in the nozzle central portion. Therefore, a droplet having an extremely small droplet volume can be ejected.

17 Claims, 20 Drawing Sheets

DROPLET EJECTING HEAD, METHOD FOR DRIVING THE SAME, AND DROPLET EJECTING APPARATUS

The present disclosure relates to the subject matter contained in Japanese Patent Application No. 2001-369133 filed on Dec. 3, 2001, which is incorporated herein by reference in its entirety.

BACKGROUND OF THE INVENTION

1. Field of the Invention

The present invention relates to a droplet ejecting head, a method for driving the same and a droplet ejecting apparatus, and particularly, relates to a droplet ejecting head, a method for driving the same and a droplet ejecting apparatus, for ejecting a fine droplet from a nozzle to thereby record characters or graphics on a recording medium or form a fine pattern or a thin film on a substrate.

2. Description of the Related Art

There is generally known a droplet ejecting method using an electromechanical transducer such as a piezoelectric actuator for generating a pressure wave (acoustic wave) in a pressure generating chamber filled with liquid so as to eject a droplet from a nozzle coupled with the pressure generating chamber due to the pressure wave. Particularly, an ink jet recording apparatus for ejecting ink droplets to thereby record characters or graphics on recording paper has been in widespread use (e.g. JP-B-Sho.53-12138 and JP-A-Hei.10-193587).

FIG. 6 is a view showing an example of a droplet ejecting mechanism (ejector) in a known ink jet recording apparatus as disclosed in these official gazettes. A nozzle 2 for ejecting ink and an ink supply path 5 for introducing ink from an ink tank (not shown) through a common flow path 4 are coupled with a pressure generating chamber 1. In addition, a diaphragm plate 6 is provided in the bottom surface of the pressure generating chamber 1. To eject a droplet, the diaphragm plate 6 is displaced by a piezoelectric actuator 7 provided outside the pressure generating chamber 1 so as to produce a change of volume in the pressure generating chamber 1. Thus, a pressure wave is generated in the pressure generating chamber. Due to this pressure wave, a part of ink charged into the pressure generating chamber 1 is jetted to the outside through the nozzle 2. Thus, the ink flies as a droplet 8. The flying droplet 8 lands on a recording medium such as a sheet of recording paper so as to form a recording dot. Such recording dots are formed repeatedly in accordance with image data. Thus, characters or graphics are recorded on the recording medium.

Further, in recent years, it has been attempted to utilize such a droplet ejecting apparatus for industrial use. For example, major applications include a) to form a wiring pattern or a transistor by ejecting a conductive polymer solution onto a substrate, b) to form an EL display panel by ejecting an organic EL solution onto a substrate, c) to form bumps for electrical mounting by ejecting molten solder onto a substrate, d) to create a three-dimensional object by laminating droplets of UV-curing resin or the like on a substrate and curing the droplets of the resin, and (e) to form an organic thin film by ejecting a solution of organic material (e.g. resist solution) onto a substrate. In such a manner, the droplet ejecting apparatus is being used in a broad variety of fields as well as for image recording, and it is expected that the range of its applications will expand more broadly.

"Reduction of droplet volume" is presently a great technical subject in such a droplet ejecting apparatus. That is, when the droplet ejecting apparatus is used for printing a photographic image or the like, it is important to make recording dots (picture elements) to be formed on a sheet of recording paper as small as possible in order to obtain high image quality with few granularity. To this end, it is necessary to make the apparatus eject very fine droplets. Also when the droplet ejecting apparatus is utilized for industrial applications, it is necessary to eject extremely fine droplets onto a substrate in order to obtain a high-density wiring pattern or a high-resolution EL display panel. The required volume of the fine droplets varies largely in accordance with how to use the droplet ejecting apparatus. For example, when an image is recorded (printed), it is substantially sufficient that fine droplets of 1–2 pl (picoliter) can be ejected. However, in order to form a high-density wiring pattern or a transistor, fine droplets not larger than 0.1 pl have to be ejected. Thus, with the range of applications of a droplet ejecting apparatus being expanded, "reduction of droplet volume" has come into a technical subject more important than ever.

As a driving method for carrying out ejection of a fine droplet in a droplet ejecting head, there is known a driving method in which a pressure generating chamber is once expanded immediately before ejection, and a droplet is ejected in the state where a meniscus in an aperture portion of a nozzle has been retracted toward the pressure generating chamber (JP-A-Sho.55-17589). FIG. 7A shows an example of a driving waveform improved in such a driving method. Incidentally, the relationship between the driving voltage and the behavior of a piezoelectric actuator varies in accordance with the structure of the actuator or the polarization direction thereof. In this specification, assume that the volume of the pressure generating chamber is reduced when the driving voltage is increased, and on the contrary, the volume of the pressure generating chamber is increased when the driving voltage is reduced.

The driving waveform shown in FIG. 7A is constituted by a first voltage change process 51 for expanding the pressure generating chamber and a second voltage change process 52 following the first voltage change process 51 for compressing the pressure generating chamber to thereby eject a droplet.

FIGS. 8A to 8D are views schematically showing the behavior of a meniscus in the nozzle aperture portion when the driving waveform shown in FIG. 7A is applied. A meniscus 9 is flat initially (FIG. 8A). When the pressure generating chamber is expanded immediately before ejection, the meniscus 9 is shaped as shown in FIG. 8B. That is, the central portion of the meniscus 9 is retracted largely toward the pressure generating chamber so that the meniscus 9 is formed into a concave shape. When the pressure generating chamber is compressed by the second voltage change process 52 in the state where the meniscus 9 is formed thus into a concave shape, a thin liquid column 22 is formed in the central portion of the meniscus 9 as shown in FIG. 8C. Next, a droplet 8 is separated from the tip portion of the liquid column 22 so as to be formed (FIG. 8D). The droplet diameter at that time is substantially equal to the thickness of the formed liquid column 22 and smaller than the aperture diameter of the nozzle 2. That is, by use of such a driving method, it is possible to eject a droplet 8 smaller than the nozzle aperture diameter. Incidentally, the driving method in which the meniscus shape immediately before ejection is controlled thus for ejecting a fine droplet will be hereinafter referred to as "meniscus control system" in this specification.

In addition, the present inventor disclosed a driving method capable of stably ejecting a smaller droplet using a driving waveform as shown in FIG. 7B, in JP-A-2000-117969. This driving waveform is constituted by a first voltage change process 51 for retracting a meniscus immediately before ejection, a second voltage change process 52 for compressing a pressure generating chamber to thereby form a liquid column, a third voltage change process 53 for separating a droplet from the tip portion of the liquid column at an early stage, and a voltage change process 54 for suppressing reverberation of a pressure wave surviving after ejection of the droplet. That is, the driving waveform of FIG. 7B includes voltage changes designed to separate a droplet at an early stage and to suppress reverberation. Consequently, a droplet (about 4 pl) smaller in volume than that by use of the driving waveform of FIG. 7A can be ejected stably.

In addition, as a method capable of ejecting a further smaller fine droplet, the inventors disclosed a driving method using proper vibration (natural oscillation) of a piezoelectric actuator in JP-A-2000-218778. This driving waveform has a feature in that a voltage change time $t_3$ of the second voltage change process 52 and a voltage change time $t_5$ of the third voltage change process 53 are set to be not larger than a natural period (natural oscillation period) $T_a$ of a piezoelectric actuator itself respectively. Consequently, the natural vibration of the piezoelectric actuator itself is excited so that high-frequency vibration can be generated in the meniscus. Accordingly, in combination of the high-frequency vibration with the meniscus control system, it is possible to eject a droplet smaller than that in a normal meniscus control system.

In addition, on the basis of the result of making investigations into the ejecting mechanism using the meniscus control system, the inventors disclosed driving waveforms advantageous to ejection of fine droplets in JP-A-2001-63042 and JP-A-2000-146992. In these driving waveforms, a voltage change time $t_1$ of the first voltage change process 51 and a time difference $t_2$ between the completion time of the first voltage change process 51 and the start time of the second voltage change process 52 are set to satisfy specific conditions. Consequently, the phases of particle velocities generated in nodes A, B and C of the driving waveform (see FIG. 7B) are substantially matched to one another so that the particle velocity at the time of applying the second voltage change process 52 can be increased suddenly. As will be described later, when there appears a large change in particle velocity at the time of applying the second voltage change process 52, strong interference of the meniscus occurs in the nozzle central portion so that a thin liquid column is formed. As a result, it is possible to eject a very fine droplet at a high velocity.

However, the droplet volume of the fine droplet that can be actually ejected by such a driving waveform as in the related art has a lower limit at about 1–2 pl. Particularly, it is impossible to eject a fine droplet not larger than 1 pl, which is required for industrial applications of the droplet ejecting apparatus.

In addition, in the droplet ejecting apparatus in the related art, there is another problem that the stability of ejection of a fine droplet is low. That is, it is indeed possible to eject a fine droplet of about 1–2 pl using a driving waveform as shown in FIG. 7B, but it is extremely difficult to carry out uniform ejection from a plurality of ejectors. One of the reasons why there is a variation in ejection state of fine droplets among the ejectors is that a fine droplet ejecting phenomenon in the related art is very sensitive to the nozzle shape or the pressure wave. That is, when a plurality of ejectors are disposed in a head, there is a variation, if slightly, among the ejectors as to the aperture diameters or sectional shapes of their nozzles, or the natural periods of pressure waves generated therein. The fine droplet ejecting method in the related art is very sensitive to such a variation so that there occurs a variation in fine droplet ejection state among the ejectors. Thus, it is difficult to carry out uniform ejection of fine droplets.

SUMMARY OF THE INVENTION

The invention was developed to solve the foregoing problems. It is an object of the invention to provide a droplet ejecting head which can eject an ultrafine droplet having a droplet volume not larger than 1 pl; a method for driving the same; and a droplet ejecting apparatus using the same.

In addition, it is another object of the invention to provide a droplet ejecting head superior in ejecting stability and uniformity in ejecting fine droplets; a method for driving the same; and a droplet ejecting apparatus using the same.

In order to solve the problems, according to the invention, there is provided a method for driving a droplet ejecting head. The droplet ejecting head includes a nozzle, a pressure generating chamber, and an electromechanical transducer. The nozzle has a straight portion formed into a substantially straight shape with a small taper angle. The pressure generating chamber communicates with the nozzle. The method for driving a droplet ejecting head comprising the steps of applying a driving voltage to the electromechanical transducer, deforming the electromechanical transducer, producing pressure change in the pressure generating chamber filled with liquid, and ejecting a droplet from the nozzle. A voltage waveform of the driving voltage includes a first voltage change process and a second voltage change process. The first voltage change process expands volume of the pressure generating chamber to retract a meniscus in the nozzle toward the pressure generating chamber. The second voltage change process compresses the volume of the pressure generating chamber to eject the droplet. Voltage change quantity and voltage change time of the first voltage change process are set so that retraction quantity D of the meniscus at a time when the second voltage change process is applied satisfies $0.8 \cdot l_n \leqq D \leqq 1.5 \cdot l_n$, where $l_n$ designates length of the straight portion.

Accordingly, in the liquid column forming step, the concave meniscus can be brought into strong interference in the nozzle central portion so that a fine droplet having an extremely small droplet volume can be ejected.

Here, the operation of the invention will be described with reference to FIGS. 9A and 9B and FIGS. 10A and 10B.

As described previously, when a fine droplet is ejected in the meniscus control system, the meniscus is retracted toward the pressure generating chamber due to the first voltage change process so that the meniscus is formed into a concave shape (this operation will be referred to as "retraction" hereinafter). Next, the meniscus is pushed toward the outside of the nozzle due to the second voltage change process (this operation will be referred to as "push" hereinafter) so as to form a thin liquid column in the nozzle central portion. The droplet diameter of the droplet ejected in the meniscus control system is substantially in agreement with the thickness of the formed liquid column. In addition, the flying velocity (droplet velocity) of the droplet is substantially in agreement with the growth rate of the liquid column. Accordingly, in order to let the fine droplet fly at a high velocity, it is important to grow a thin liquid column at a high rate.

The inventors have formerly made investigations into such a liquid column forming mechanism through ejection observation tests and fluid analyses. Thus, the inventors discover that bringing the liquid surface into strong interference in the nozzle central portion is a requirement for forming a thin liquid column. The driving waveform disclosed in JP-A-2001-63042 and JP-A-2001-328259 is based on such knowledge, where the phases of particle velocities generated in nodes A, B and C of the driving waveform (see FIG. 7B) are substantially matched to one another so that the particle velocity at the time of applying the second voltage change process is increased suddenly so as to produce strong interference of the meniscus in the nozzle central portion.

However, the inventors have made investigations in more detail. As a result, it is proved that the driving waveform is indeed effective in ejecting fine droplets, but in some nozzle shape or some meniscus retraction quantity, it is not always possible to eject fine droplets satisfactorily. It can be said that this is because understanding of the behavior of the meniscus at the time of applying the second voltage change process was not sufficient. That is, JP-A-2001-63042 and JP-A-2001-328259 disclose that when "push" is applied to the concave meniscus, each part of the meniscus moves in the direction of a normal line of the liquid surface so that plenty of ink concentrates in the nozzle central portion, and a liquid column is formed in the nozzle central portion due to this local volume increase, as shown in FIGS. 9A and 9B. However, as a result of researches in detail through fluid analyses and actual measurement evaluations made by the inventor, it is made clear that when "push" is applied to the concave meniscus, each part of the meniscus does not always move in the direction of the normal line of the liquid surface but the behavior of the meniscus depends largely on the nozzle shape.

FIGS. 10A and 10B are views schematically showing a variation of the behavior of a meniscus in accordance with the nozzle shape. Here, the moving velocity of the meniscus will be considered in the stages of two components, that is, a component (Y-component) parallel with the nozzle central axis and a component (R-component) approaching the nozzle center (central axis). In order to obtain fine droplet ejection, a velocity vector with a large R-component has to be generated in the meniscus so as to produce strong interference of the liquid surface in the nozzle central portion.

As a result of the fluid analyses and the actual measurement evaluations, it is proved that in the case ($D<<l_n$) that the retracted meniscus stays in the straight portion of the nozzle as shown in FIG. 10A, the meniscus suffering "push" has a velocity vector whose Y-component is large. That is, it is proved that the condition of $D<<l_n$ is disadvantageous to fine droplet ejection because a velocity vector having a large R-component can not be obtained and hence liquid surface interference can not be produced efficiently in the nozzle central portion.

On the other hand, it is proved that in the case that the retraction quantity D of the meniscus and the length $l_n$ of the nozzle straight portion are set to be substantially equal to each other as shown in FIG. 10B, a velocity vector dominated by an R-component is generated in the meniscus when "push" is applied thereto. It can be considered that this is because a flow rate distribution with a large R-component appears near the lower end of the nozzle straight portion. That is, by setting of $D \approx l_n$, a velocity vector with a large R-component can be generated in the tip portion of the meniscus. Thus, strong interference of the liquid surface can be produced in the nozzle central portion so that an extremely thin liquid column can be formed.

As described above, in order to produce strong liquid surface interference (extremely thin liquid column) essential for fine droplet ejection, not only is it necessary to increase the liquid surface velocity, but it is also necessary to establish such a relationship between the meniscus retraction quantity D and the nozzle straight portion length $l_n$ that the R-component of the velocity vector increases near the meniscus tip portion, as described in JP-A-2001-63042 and JP-A-2001-328259. The method for driving a droplet ejecting head according to the invention has a feature in that the retraction quantity D of the meniscus is set to satisfy the condition of $0.8 \cdot l_n \leqq D \leqq 1.5 \cdot l_n$ so as to produce strong liquid surface interface in the nozzle central portion.

Further, in the method for driving a droplet ejecting head according the invention, preferably, a voltage change time of the second voltage change process is set to be not larger than ⅓ of $T_c$ which designates a natural period of a pressure wave generated in the pressure generating chamber. Accordingly, a high particle velocity can be obtained when the second voltage change process is applied, while a droplet can be separated from the liquid column at an early stage. Thus, there can be obtained an effect that a fine droplet with a small droplet volume can be ejected.

In addition, in the method for driving a droplet ejecting head according to the invention, preferably, the voltage waveform of the driving voltage is formed to include a third voltage change process for expanding the volume of the pressure generating chamber immediately after the second voltage change process. Accordingly, a droplet can be separated from the liquid column at an earlier stage. Thus, there can be obtained an effect that a fine droplet with a smaller droplet volume can be ejected. Incidentally, in order to obtain the effect effectively, a voltage change time of the third voltage change process is preferably set to be not larger than ⅓ of the natural period $T_c$. Further, a time interval between a completion time of the second voltage change process and a start time of the third voltage change process is preferably set to be not larger than ⅕ of the natural period $T_c$.

In addition, in the method for driving a droplet ejecting head according to the invention, preferably, the voltage waveform of the driving voltage is formed to include a fourth voltage change process for compressing the volume of the pressure generating chamber immediately after the third voltage change process. Accordingly, the reverberation of the pressure wave after the ejection of a fine droplet can be suppressed. Thus, there can be obtained an effect that stability in continuous ejection of fine droplets can be improved. Incidentally, in order to obtain the effect effectively, a voltage change time of the fourth voltage change process is preferably set to be not larger than ½ of the natural period $T_c$.

In addition, in the method for driving a droplet ejecting head according to the invention, preferably, a voltage change time of the first voltage change process is set to be larger than a natural period $T_a$ of proper vibration of the electromechanical transducer and smaller than the natural period $T_c$. Accordingly, a good meniscus shape can be obtained when the meniscus is retracted. Thus, there can be obtained an effect that fine droplet ejection can be stabilized.

In addition, in the method for driving a droplet ejecting head according to the invention, preferably, a voltage change time of the first voltage change process is set to be substantially equal to ½ of the natural period $T_c$ of the pressure wave in the pressure generating chamber and a start time of the second voltage change process is set to be immediately after the first voltage change process is completed. Accordingly, a high particle velocity can be generated in the meniscus when the second voltage change process is applied, so that the liquid surface interference in the nozzle central portion can be enhanced. Thus, there can be obtained an effect that a fine droplet with a smaller droplet volume can be ejected. Incidentally, in order to obtain the effect effectively, a time interval between a completion time of the first voltage change process and a start time of the second voltage change process is preferably set to be not larger than ⅕ of the natural period $T_c$.

In the method for driving a droplet ejecting head according to the invention, preferably, a voltage change time $t_1$ of the first voltage change process and a time interval $t_2$ between a completion time of the first voltage change process and a start time of the second voltage change process are set to satisfy the following relational expressions:

$$t_2 = t_0 - t_1$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right]$$

Accordingly, a high particle velocity can be generated in the meniscus when the second voltage change process is applied, so that the liquid surface interference in the nozzle central portion can be enhanced. Thus, there can be obtained an effect that a fine droplet with a smaller droplet volume can be ejected.

In addition, in the method for driving a droplet ejecting head according to the invention, preferably, a voltage change time of the second voltage change process is set to be not larger than a natural period $T_a$ of proper vibration of the electromechanical transducer. Accordingly, an extremely high particle velocity can be obtained when the second voltage change process is applied, while a droplet can be separated from the liquid column at an extremely early stage. Thus, there can be obtained an effect that a fine droplet with a very small droplet volume can be ejected. Incidentally, in order to obtain the effect effectively, a voltage change time of the third voltage change process is preferably set to be not larger than the natural period $T_a$ of proper vibration of the electromechanical transducer, and a difference $t_0$ between a start time of the second voltage change process and a start time of the third voltage change process is preferably set to satisfy:

$$T_a/2 \leq t_0 \leq T_a$$

In order to solve the problems, according to the invention, there is provided a droplet ejecting head having at least a nozzle having a straight portion formed into a substantially straight shape with a small taper angle, a pressure generating chamber communicating with the nozzle and an electromechanical transducer; wherein a driving voltage formed to include at least a first voltage change process for expanding volume of the pressure generating chamber to thereby retract a meniscus in the nozzle toward the pressure generating chamber and a second voltage change process following the first voltage change process for compressing the volume of the pressure generating chamber to thereby eject a droplet is applied to the electromechanical transducer so as to produce a change of pressure in the pressure generating chamber to thereby eject a droplet from the nozzle; and wherein length $l_n$ of the straight portion is set to satisfy:

$$D/1.5 \leq l_n \leq D/0.8$$

where D designates a retraction quantity of the meniscus when the second voltage change process is applied. Accordingly, in the liquid column forming step, the concave meniscus can be brought into strong interference in the nozzle central portion, so that a fine droplet with an extremely small droplet volume can be ejected.

In addition, in the droplet ejecting head according to the invention, preferably, the nozzle has a taper portion connected to the straight portion. Accordingly, bubbles can be prevented from being involved into the inside of the nozzle when the meniscus is retracted. Thus, there can be obtained an effect that a droplet ejecting head superior in reliability can be attained.

In addition, in the droplet ejecting head according to the invention, preferably, the length $l_n$ of the straight portion is set to satisfy:

$$0.8\cdot d_n \leq l_n \leq 2.0\cdot d_n$$

where $d_n$ designates an aperture diameter of the nozzle. Accordingly, there can be obtained an effect that a meniscus having a small curvature radius advantageous to fine droplet ejection can be obtained by minimum meniscus retraction.

In addition, in the droplet ejecting head according to the invention, preferably, the natural period $T_c$ of the pressure wave is set to be not larger than 15 $\mu$s. Accordingly, a large change of meniscus velocity can be obtained when the second voltage change process is applied. Thus, there can be obtained an effect that a fine droplet with a small droplet volume can be ejected.

In addition, in the droplet ejecting head according to the invention, preferably, the natural period $T_a$ of proper vibration of the electromechanical transducer is set to be not larger than 5 $\mu$s. Accordingly, by use of the driving method using the proper vibration of the electromechanical transducer, a very large change of meniscus velocity can be obtained when the second voltage change process is applied. Thus, there can be obtained an effect that a fine droplet with a smaller droplet volume can be ejected.

In addition, in the droplet ejecting head according to the invention, preferably, the aperture diameter of the nozzle is set to be not larger than 20 $\mu$m. Accordingly, there can be obtained an effect that a meniscus with a small curvature radius advantageous to fine droplet ejection can be obtained.

In addition, in the droplet ejecting head according to the invention, preferably, the electromechanical transducer is formed to include a piezoelectric vibrator. Accordingly, there can be obtained an effect that a pressure wave required for fine droplet ejection can be generated effectively in the pressure generating chamber. Incidentally, in order to eject a droplet having a small droplet volume, the piezoelectric vibrator is preferably a piezoelectric vibrator of a longitudinal vibration mode.

In addition, according to the invention, there is provided a droplet ejecting apparatus mounted with a droplet ejecting head defined above. Accordingly, an extremely fine droplet can be ejected onto a medium so as to attain recording of a high-quality image, formation of a high-density wiring pattern, manufacturing of a high-density display panel, and so on.

DETAILED DESCRIPTION OF THE PREFERRED EMBODIMENTS

Next, description will be made in detail embodiments of the invention with reference to the drawings.

[First Embodiment]

Figure 1:
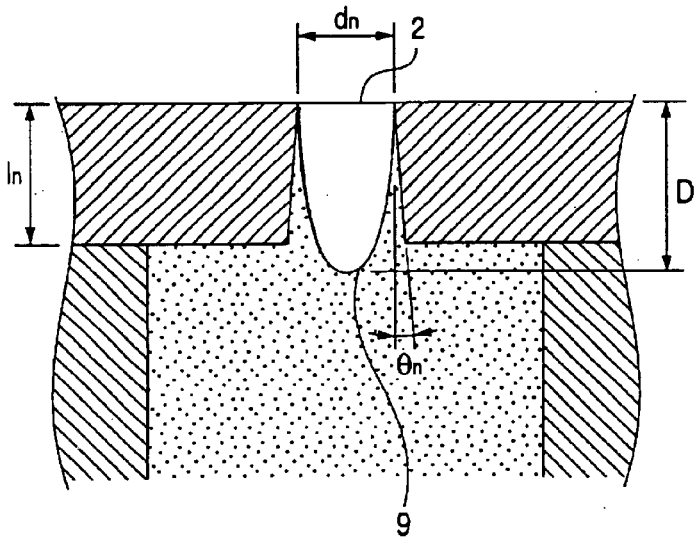
FIG. 1 is a view showing the nozzle shape in a first embodiment of the invention.
Figure 2:
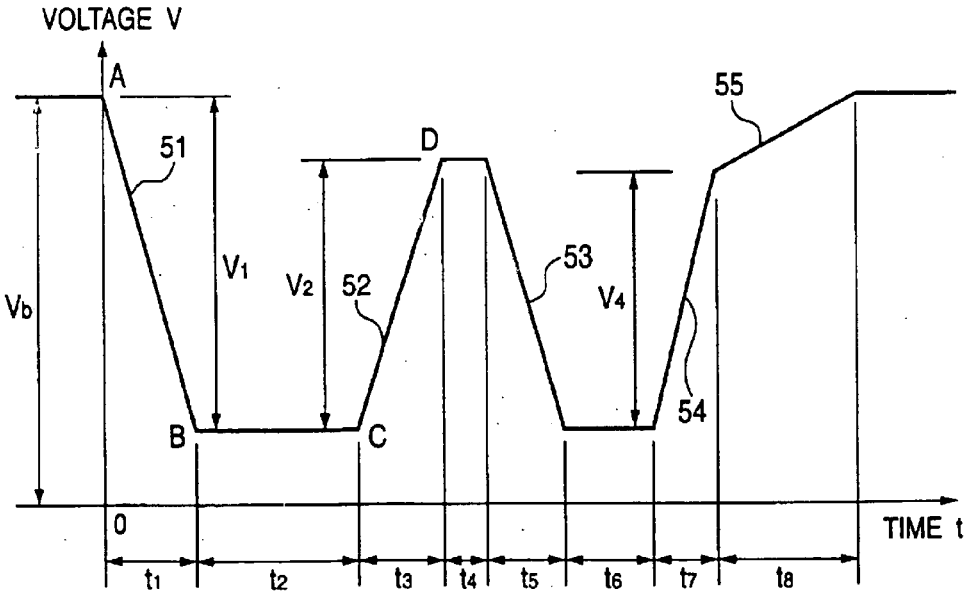
FIG. 2 is a graph showing a driving waveform in the first embodiment of the invention.

FIG. 1 is an enlarged view of a nozzle portion of a droplet ejecting head according to a first embodiment of the invention. FIG. 2 is a graph showing a driving waveform (voltage waveform of a driving voltage applied to an electromechanical transducer) of the droplet ejecting head according to the first embodiment. The basic configuration of the droplet ejecting head as a whole is made the same as the related-art droplet ejecting head shown in FIG. 6.

The droplet ejecting head according to the first embodiment is manufactured by laminating and bonding a plurality of stainless steel plates (50–150 μm thick) through a bonding agent, which plates are perforated by etching or the like. The head is provided with 32 pressure generating chambers 1 (arrayed in the vertical direction of the paper in FIG. 6), which are connected with a common flow path 4 through supply paths 5, respectively. The common flow path 4 is connected to a liquid tank (not shown) so as to have a function of introducing liquid into the respective pressure generating chambers 1. Nozzles 2 for ejecting droplets 8 are connected to the pressure generating chambers 1, respectively. In addition, a diaphragm plate 6 is formed in the bottom surfaces of the pressure generating chambers 1, and piezoelectric actuators (piezoelectric vibrators) 7 are attached as electromechanical transducers to the diaphragm plate 6. When a driving waveform (driving voltage) is applied to the piezoelectric actuator 7, the piezoelectric actuator 7 is deformed to expand or compress the corresponding pressure generating chamber 1 filled with the liquid. When there occurs a change of volume in the pressure generating chamber 1, a pressure wave is generated in the pressure generating chamber 1. The liquid in the nozzle portion makes a motion by the effect of the pressure wave so that the liquid is discharged to the outside through the nozzle 2. Thus, a droplet 8 is formed.

In this first embodiment, each nozzle 2 is formed by perforating a polyimide film by excimer laser. The nozzle aperture diameter is set at 20 μm, the nozzle length is set at 25 μm, and the sectional shape of the nozzle 2 is formed into a substantially straight shape with a taper angle not larger than 10° (see FIG. 1). That is, in the first embodiment, the nozzle 2 is formed out of only a straight portion.

Each supply path 5 is formed by perforating a stainless plate with a press, so as to have a tapered shape with an aperture diameter of about 30 μm and a length of 75 μm. A nickel thin plate formed by electroforming is used as the diaphragm plate 6. A laminated piezoelectric ceramic is used for the piezoelectric actuators 7.

Figure 27:
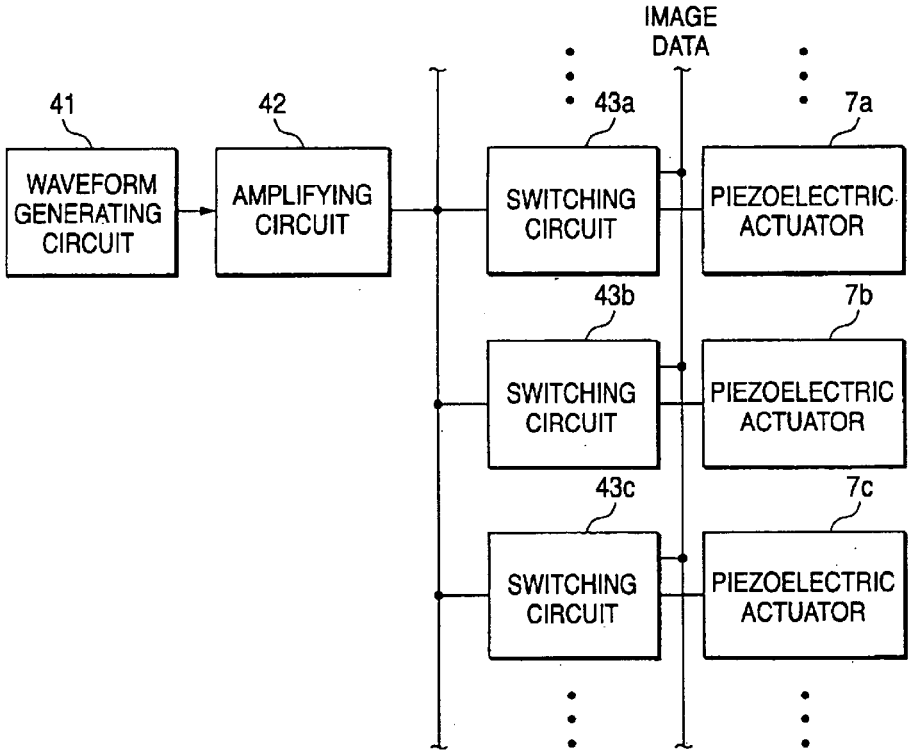
FIG. 27 is a block diagram showing the configuration of a driving circuit of a droplet ejecting head.

FIG. 27 is a diagram showing the basic configuration of a driving circuit for driving the piezoelectric actuators. The driving circuit is constituted by a waveform generating circuit 41, an amplifying circuit 42 and switching circuits (transfer gate circuits) 43. The waveform generating circuit 41 is constituted by a digital-to-analog converting circuit and an integrating circuit so as to convert driving waveform data into an analog signal, and then integrate the analog signal to thereby generate a driving waveform signal. The amplifying circuit 42 voltage-amplifies and/or current-amplifies the driving waveform signal supplied from the waveform generating circuit 41, and outputs the signal as an amplified driving waveform signal. The switching circuits 43*a*, 43*b* and 43*c* perform ON/OFF control of droplet ejection. The switching circuits 43*a*, 43*b* and 43*c* apply the driving waveform signal to the piezoelectric actuators 7 in accordance with a signal generated from image pattern data or the like.

Figure 28:
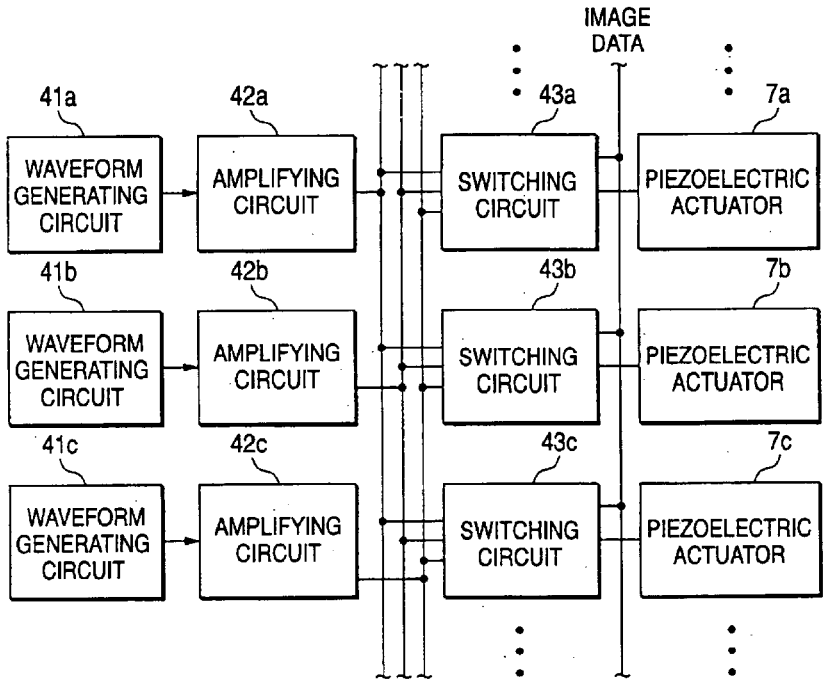
FIG. 28 is a block diagram showing the configuration of another driving circuit of a droplet ejecting head.

Incidentally, to change the diameter of a droplet to be ejected in multi-stages, that is, to carry out droplet diameter modulation, a driving circuit as shown in FIG. 28 is used. To modulate the droplet diameter into three stages (large droplet, medium droplet and small droplet), the driving circuit in this example is provided three kinds of waveform generating circuits 41*a*, 41*b* and 41*c* corresponding to those droplet diameters respectively. The waveforms are amplified by amplifying circuits 42*a*, 42*b* and 42*c* respectively. At the time of recording, the driving waveforms to be applied to the piezoelectric actuators 7 are changed over by switching circuits 43*a*, 43*b* and 43*c* in accordance with image pattern data or the like. Thus, droplets having desired diameters are ejected. Incidentally, the driving circuit for driving the piezoelectric actuators is not limited to those configured as shown in this embodiment. Driving circuits having other configurations may be used.

The driving waveform used in this first embodiment is constituted by a first voltage change process 51 for expanding the pressure generating chamber 1 immediately before ejection, a second voltage change process 52 for compressing the pressure generating chamber 1 at a sharp rate, a third voltage change process 53 for expanding the pressure generating chamber 1 at a sharp rate, a fourth voltage change process 54 for compressing the pressure generating chamber 1 again at a sharp rate, and a fifth voltage change process 55 for restoring the applied voltage to its reference voltage. Voltage change times in the voltage changes of those processes are set at 2 μs in a section $t_1$, 2 μs in a section $t_2$, 2 μs in a section $t_3$, 0.5 μs in a section $t_4$, 2 μs in a section $t_5$, 0.3 μs in a section $t_6$, 2.2 μs in a section $t_7$, and 6 μs in a section $t_8$. On the other hand, voltage change quantities in the voltage changes of those processes are set at 15 V in voltage change quantity $V_1$, 8 V in voltage change quantity $V_2$, 14 V in voltage change quantity $V_3$, and 20 V in bias voltage $V_b$.

When this driving waveform is applied to the piezoelectric actuator, the meniscus in the nozzle aperture portion is once retracted toward the pressure generating chamber due to the first voltage change process 51 so that the meniscus is formed into a concave shape (see FIG. 1). After that, when the second voltage change process 52 is applied, a thin liquid column is formed in the nozzle central portion (see FIG. 1), and the liquid column is separated in a early stage due to the third voltage change process 53. Thus, a droplet smaller than the nozzle diameter is ejected. In addition, the reverberation of the pressure wave surviving after the droplet ejection is suppressed by the fourth voltage change process 54.

Figure 11A:
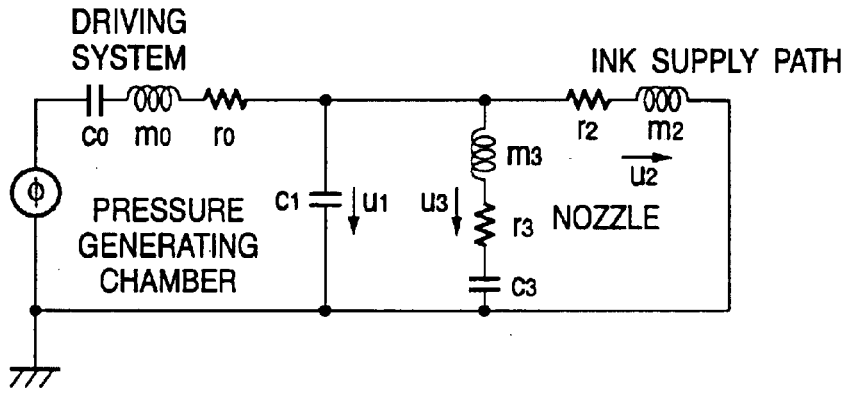
FIGS. 11A to 11C are diagrams showing equivalent electric circuits of a droplet ejection head.

Here, description will be made on an equivalent electric circuit model for obtaining the particle velocity and position of the meniscus by theoretical calculation. FIG. 11A shows an equivalent electric circuit substituted for the droplet ejecting head shown in FIG. 6. Here, the signs m, r, c, u and $\phi$ designate inertance [$kg/m^4$], acoustic resistance [$Ns/m^5$], acoustic capacitance [$m^5/N$], volume velocity [$m^3/s$] and pressure [Pa] respectively, and suffixes 0, 1, 2 and 3 designate a driving portion (piezoelectric actuator), a pressure generating chamber, a supply path and a nozzle respectively.

Figure 11B:
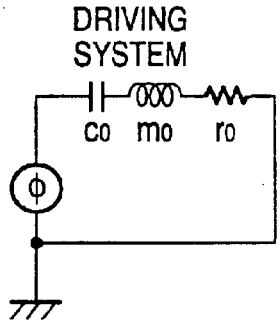
Figure 11C:
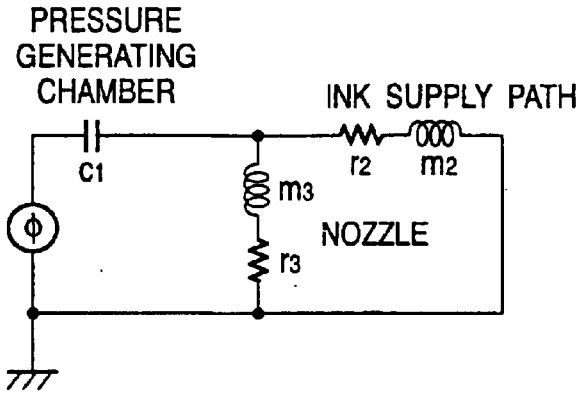

In the circuit of FIG. 11A, the inertance $m_0$, the acoustic resistance $r_0$ and the acoustic capacitance $c_0$ of the vibrating system are negligible when high-rigidity laminated piezoelectric actuators are used as the piezoelectric actuators in the circuit of FIG. 11A and each voltage change process of the driving waveform is set to exceed the natural period (natural oscillation period) $T_a$ (which will be described later) of the proper vibration (natural oscillation) of each piezoelectric actuator. In addition, for the analysis of the pressure wave, the acoustic capacitance $c_3$ of the nozzle is also negligible. Thus, the circuit of FIG. 11A can be simplified as shown in FIG. 11C.

Figure 12A:
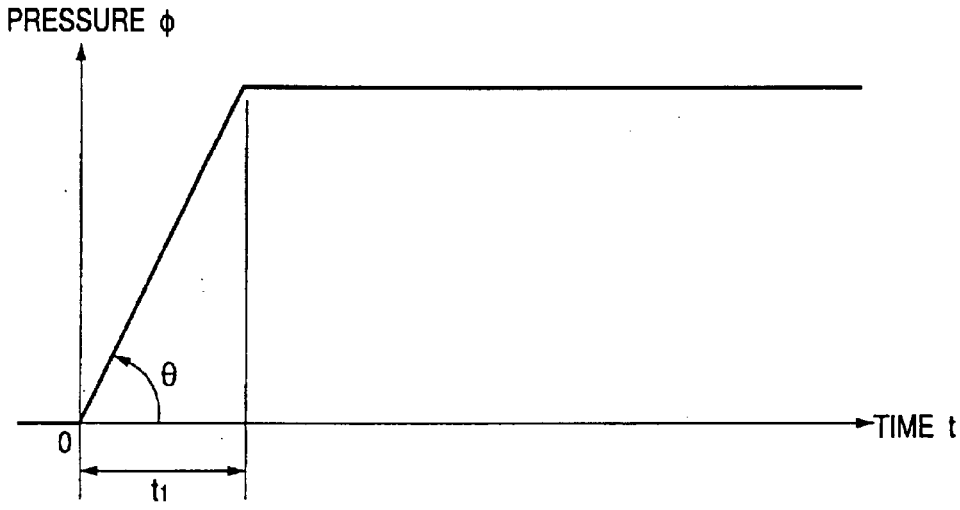
FIGS. 12A and 12B are graphs for explaining the relationship between the driving waveform and the nozzle portion particle velocity.

Assume that the relationship of $m_2=k\cdot m_3$ and $r_2=k\cdot r_3$ is established in the inertance and acoustic resistance between the nozzle and the supply path. When circuit analysis is performed on the case where a driving waveform having a rise angle $\theta$ as shown in FIG. 12A is supplied, the particle velocity $v_3'$ in the nozzle portion within the time of $0 \leqq t \leqq t_1$ is expressed by:

$$v_3'(t,\theta) = \frac{c_1 \tan\theta}{A_3\left(1+\frac{1}{k}\right)}\left[1-\frac{W}{E_c}\exp(-D_c\cdot t)\sin(E_c\cdot t-\phi_0)\right](0 \le t \le t_1$$

$$E_c = \sqrt{\frac{1+\frac{1}{k}}{c_1 m_3} - D_c^2}$$

$$D_c = \frac{r_3}{2m_3}$$

$$w^2 = \frac{1+1/k}{c_1 m_3}$$

$$\phi_0 = \tan^{-1}\left(\frac{E_c}{D_c}\right)$$

where $A_3$ designates the nozzle aperture area.

Figure 12B:
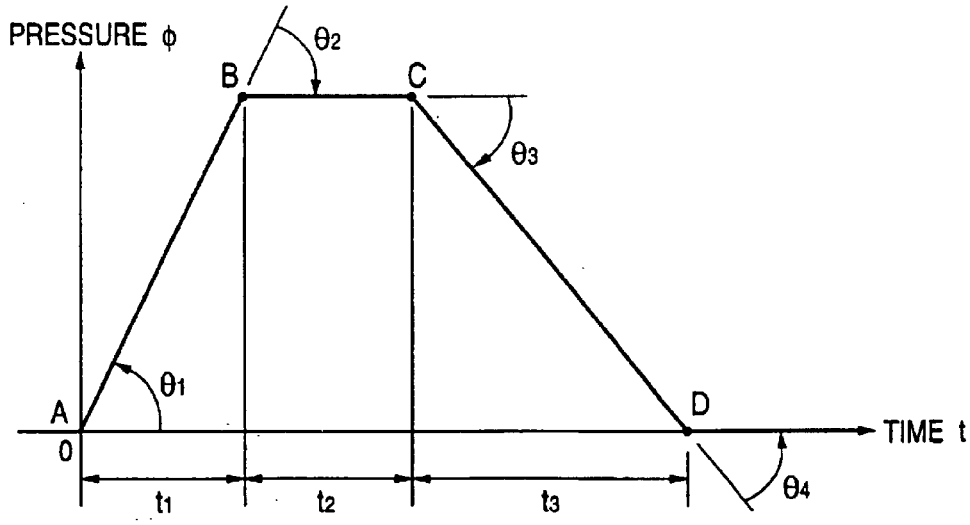

The particle velocity in the case where a driving waveform having a complicated shape as shown in FIG. 12B is used can be obtained by laying particle velocities generated in each node (A, B, C and D) of the driving waveform on the other sequentially. That is, the particle velocity $v_3$ generated in the driving waveform of FIG. 12B is expressed by:

$$\left.\begin{aligned}
v_3(t) &= v_3'(t,\theta_1)\ (0 \le t \le t_1)\\
v_3(t) &= v_3'(t,\theta_1) + v_3'(t-t_1,\theta_2)\ (t_1 \le t \le t_1+t_2)\\
v_3(t) &= v_3'(t,\theta_1) + v_3'(t-t_1,\theta_2) +\\
&\quad v_3'(t-t_1-t_2,\theta_3)\ (t_1+t_2 \le t \le t_1+t_2+t_3)\\
v_3(t) &= v_3'(t,\theta_1) + v_3'(t-t_1,\theta_2) +\\
&\quad v_3'(t-t_1-t_2,\theta_3) +\\
&\quad v_3'(t-t_1-t_2-t_3,\theta_4)\ (t \ge t_1+t_2+t_3)
\end{aligned}\right\} \quad (2)$$

Figure 3:
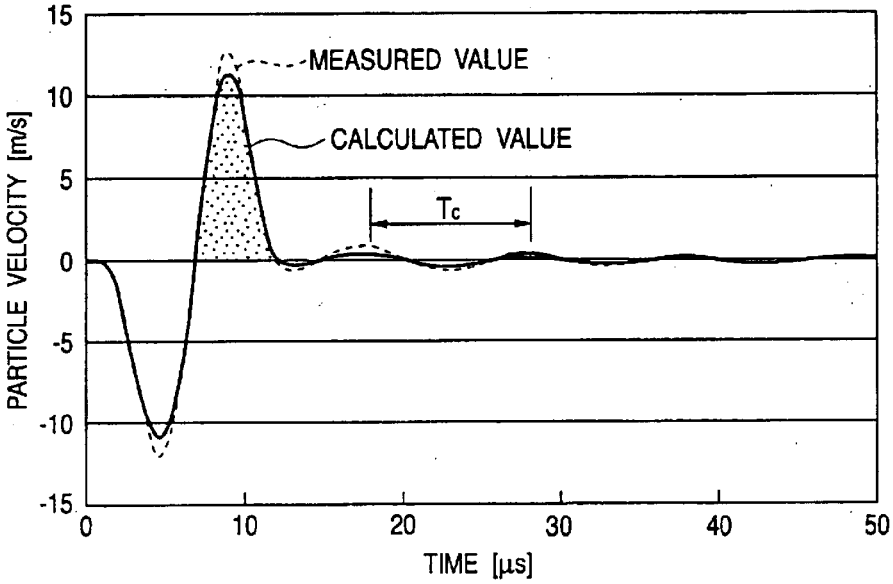
FIG. 3 is a graph showing a nozzle portion particle velocity in the first embodiment of the invention.

The solid line in FIG. 3 shows a result of the particle velocity of the meniscus obtained by the expressions (2) when the driving waveform of FIG. 2 is supplied. Incidentally, the particle velocity obtained by the expressions (2) is in good agreement with the measured result (broken line in FIG. 3) using a laser Doppler velocimeter, and it was confirmed that the particle velocity of the meniscus could be obtained accurately by the expressions (2). Incidentally, in the droplet ejecting head according to this embodiment, the natural period $T_c$ of the pressure wave generated in the pressure generating chamber 1 is 10 $\mu$s.

The meniscus retraction quantity (volume) immediately before droplet ejection can be obtained as the product of the area of the shaded area in FIG. 3 and the nozzle aperture diameter. When the sectional shape of the meniscus approximates a parabolic shape, the meniscus retraction quantity (tip position) D in this embodiment is calculated at about 30 $\mu$m. That is, in this embodiment, the tip of the retracted meniscus projects slightly from the lower end of the nozzle a shown in FIG. 1.

Figure 10A:
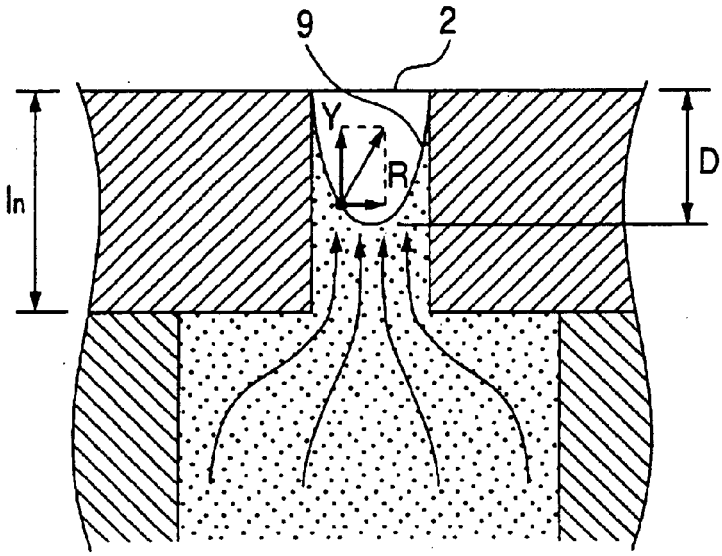
FIGS. 10A and 10B are schematic views for explaining the operation of the invention.
Figure 10B:
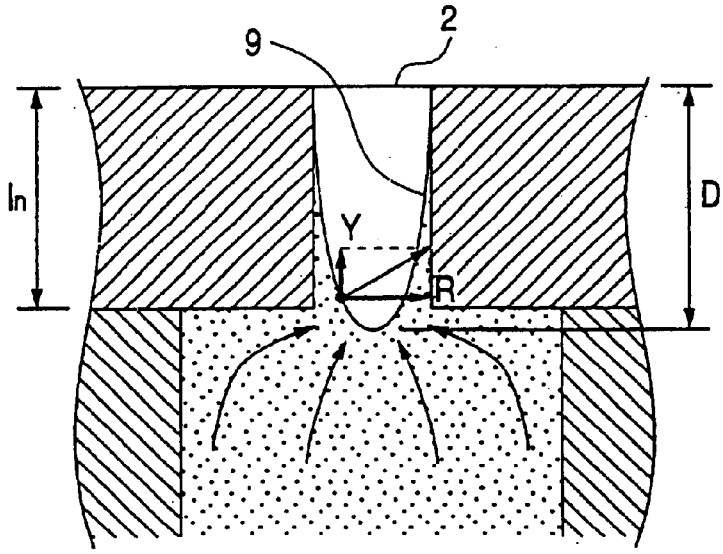

As described above, by setting the meniscus retraction quantity D to be substantially equal to the nozzle length $l_n$, a velocity vector having a large R-component can be generated near the tip portion of the meniscus when "push" is applied to the meniscus in the second voltage change process 52 (see FIG. 10B). Consequently, strong liquid surface interference can be produced in the nozzle central portion so that an extremely thin liquid column can be formed. An ejection test using the droplet ejecting head according to this embodiment is performed practically. As a result, a fine droplet having a droplet volume of 1 pl and a droplet velocity of 8 m/s can be ejected.

Figure 4:
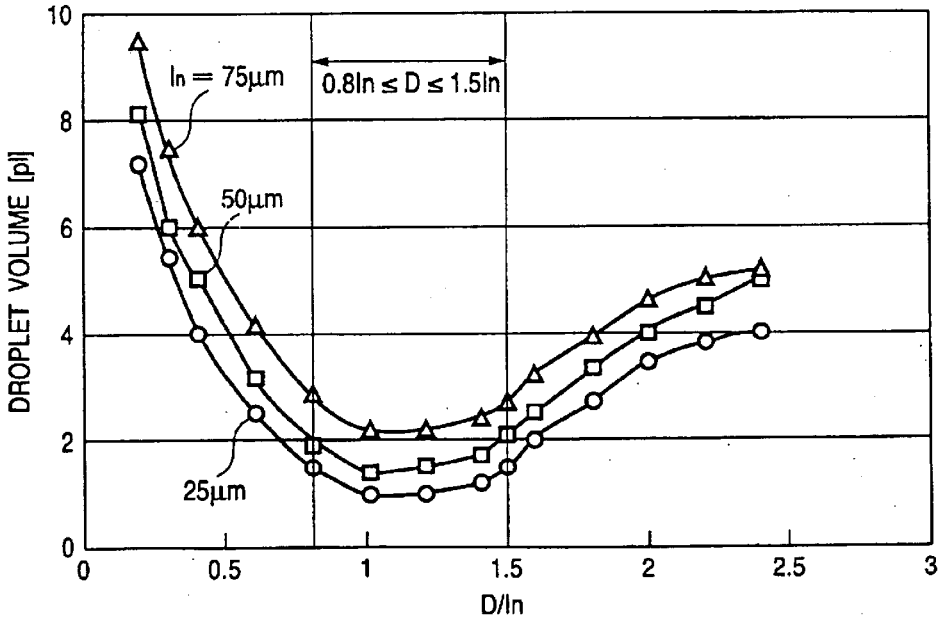
FIG. 4 is a graph showing the relationship between the meniscus retraction quantity and the droplet volume.
Figure 13:
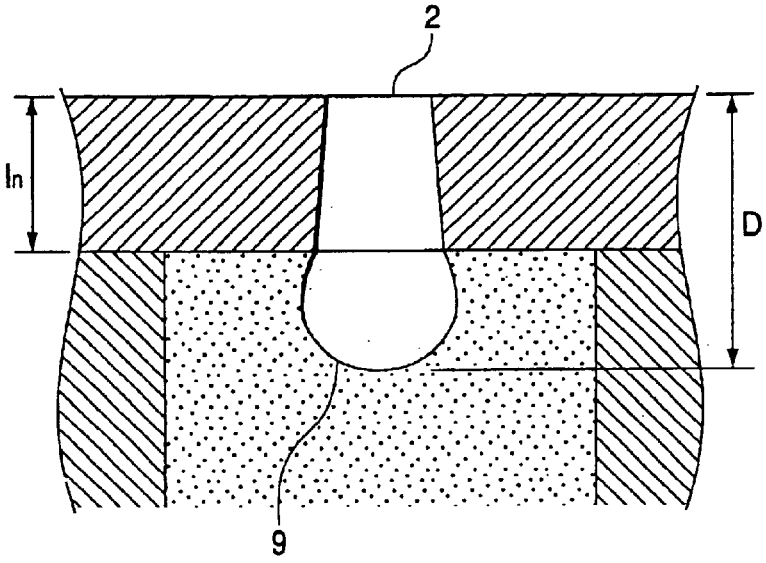
FIG. 13 is a view showing the nozzle shape when the meniscus retraction quantity is excessive.

FIG. 4 shows the result of making examination into minimum droplet diameters obtained by changing the meniscus retraction quantity D and the nozzle length $l_n$. The meniscus retraction quantity D is changed by increasing/reducing the voltage change quantity $V_1$ in the driving waveform of FIG. 2. From this result, it is understood that a very small droplet can be obtained when the meniscus retraction quantity D is set to be within the range of $0.8\cdot l_n \leqq D \leqq 1.5\cdot l_n$, while it is difficult to eject a fine droplet satisfactorily under the condition of $D \leqq 0.8\cdot l_n$. This is because a velocity vector having a large R-component cannot be generated in the meniscus under the condition of $D \leqq 0.8\cdot l_n$. In addition, it is confirmed that the droplet volume increases also in the range of $D \geqq 1.5\cdot l_n$. It is considered that this is because when the meniscus retraction quantity D is much larger than the nozzle length $l_n$, the meniscus has a shape as shown in FIG. 13 so that the curvature radius of the meniscus increases. Accordingly, in order to eject a fine droplet with a small droplet volume stably, it is optimum to set the meniscus retraction quantity D to be within the range of:

$$0.8\cdot l_n \leqq D \leqq 1.5\cdot l_n \quad (3)$$

In addition, in this embodiment, it is confirmed that the stability and the uniformity in fine droplet ejection are very high. Specifically, when fine droplets are ejected concurrently from 32 ejectors provided in the head, it is possible to obtain uniformity within about ±2% in both droplet volume and droplet velocity of the fine droplets ejected from the respective nozzles. In addition, it is confirmed that even when the driving frequency is varied in a range of 1–15 kH, both the variation in droplet volume and the variation in droplet velocity can be suppressed within ±3%. It can be said that the droplet head according to the invention is very excellent in stability and uniformity in fine droplet ejection in comparison with droplet ejecting heads and driving methods in the related art where there occurs a variation of about ±5% or wider both in droplet volume and droplet velocity among ejectors and there occurs a variation of about ±8% or wider likewise in accordance with a variation of the driving frequency.

The reason why the stability and uniformity of fine droplet ejection can be improved in the droplet ejecting head and the driving method according to the invention depends on the method for forming a very thin liquid column required for ejecting a fine droplet. That is, since a very thin liquid column was formed only by the optimization of a driving waveform in the fine droplet ejecting method in the related art, the condition with which the liquid column was formed was varied in accordance with the scattering of the natural period $T_c$ among ejectors or the like. Thus, a large variation was consequently produced in droplet volume or droplet velocity. On the other hand, in the droplet ejecting head and the driving method according to the invention, a very thin liquid column is formed by optimum setting of the meniscus retraction quantity and the nozzle shape. For the meniscus retraction quantity or the nozzle shape, it is easy to secure uniformity in comparison with the natural period $T_c$ or the like. Accordingly, in the droplet ejecting head and the driving method according to the invention, it is possible to eject fine droplets with high stability and high uniformity.

Incidentally, the nozzle aperture diameter and the nozzle length are set at 20 μm and 25 μm, respectively, in this embodiment in order to form a meniscus having a small curvature radius advantageous to fine droplet ejection. That is, when the sectional shape of the retracted meniscus is regarded as parabolic, the curvature radius R at the tip of the meniscus can be expressed by:

$$R=d_n^2/(8\cdot D) \tag{4}$$

That is, in order to reduce the curvature radius R at the tip of the meniscus, it is effective to reduce the nozzle diameter $d_n$ and increase the meniscus retraction quantity D. Therefore, in this embodiment, the nozzle aperture diameter is set at 20 μm to be small, and further the nozzle length $l_n$ (≈meniscus retraction quantity D) is set at 25 μm to be large. Thus, a meniscus having a small curvature radius advantageous to fine droplet ejection is formed.

In addition, as a result of fluid analyses, it is proved that when the meniscus retraction quantity D exceeds a predetermined value relative to the nozzle diameter $d_n$, the meniscus shape is not the parabolic shape anymore and the curvature radius is not reduced very much. In addition, as a result of ejecting tests, it is also proved that when the meniscus retraction quantity is set to be very large, particularly the stability in fine droplet ejection at the time of continuous ejection is degraded. It is therefore desired that the meniscus retraction quantity D is set at a required minimum.

Figure 5:
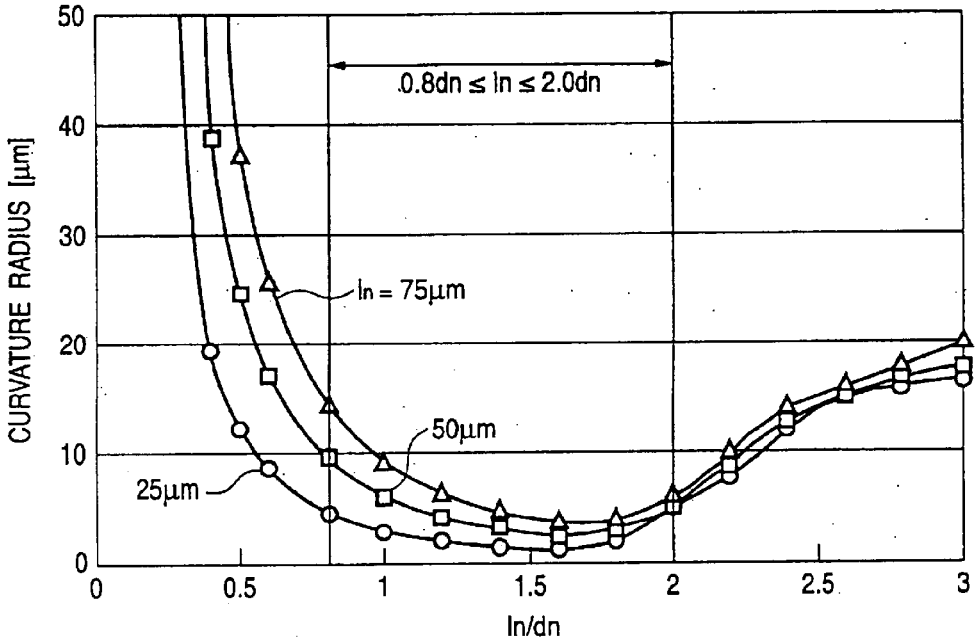
FIG. 5 is a graph showing the relationship between the meniscus retraction quantity and the curvature radius at the meniscus tip portion.

FIG. 5 shows the result of making examination into the relationship between the meniscus retraction quantity D and the curvature radius R. It is proved that the relationship of the expression (4) is established between D and R in the range of $D \leqq 2.0\cdot d_n$, but R does not depend on D in the range of $D>2.0\cdot d_n$. In addition, it is difficult to obtain a small curvature radius R in the range of $D \leqq 0.8\cdot d_n$. In order to obtain a meniscus having a small curvature radius with a minimum meniscus retraction quantity, it is therefore desired to set the relationship between the nozzle aperture diameter $d_n$ and the nozzle length $l_n$ (≈meniscus retraction quantity D) to satisfy the following expression:

$$0.8\cdot d_n \leqq l_n \leqq 2.0\cdot d_n$$

Further it is preferable to set the same relation to satisfy:

$$1.0\cdot d_n \leqq l_n \leqq 1.6\cdot d_n$$

In addition, in order to obtain a meniscus having a small curvature radius advantageous to fine droplet ejection, it is desired that the taper angle $\theta_n$ of the nozzle (or the straight portion of the nozzle) is small, and specifically it is preferably not larger than 10°. Incidentally, even by use of a taper angle out of this range, the effect of the invention can be obtained though it is insufficient.

Incidentally, in order to eject a droplet having a small droplet volume, it is preferable that the voltage change time $t_3$ of the second voltage change process 52 and the voltage change time $t_5$ of the third voltage change process 53 are set to be not larger than ⅓ of the natural period $T_c$ respectively, as in the embodiment. In addition, it is preferable that the time interval ($t_4$) between the completion time of the second voltage change process 52 and the start time of the third voltage change process 53 is set to be not larger than ⅕ of the natural period $T_c$. This is because by use of such a driving waveform, a large particle velocity can be obtained at the time of droplet ejection, and the droplet can be separated from the liquid column at an early stage so that it is possible to eject a fine droplet having a small droplet volume. That is, it is advantageous for fine droplet ejection to reduce the shaded area in FIG. 3. By use of such a driving waveform, it is possible to obtain a change of particle velocity small in shaded area.

In addition, in order to attain stable ejection of a fine droplet, it is effective to suppress the reverberation of the pressure wave after droplet ejection due to the fourth voltage change process 54 as in this embodiment. In the change of particle velocity in FIG. 3, the amplitude of the particle velocity is very small in the range of t>12 μs. This is because the reverberation of the pressure wave after droplet ejection is suppressed well due to the fourth voltage change process 54. When the reverberation of the pressure wave after droplet ejection is suppressed thus, every ejection is hardly affected by the last ejection in the case of continuous ejection of fine droplets. Thus, the fine droplets can be ejected continuously and stably. Incidentally, in order to suppress the reverberation effectively, it is preferable that the voltage change time $t_7$ of the fourth voltage change process 54 is set to be not larger than ½ of the natural period $T_c$.

[Second Embodiment]

Figure 14:
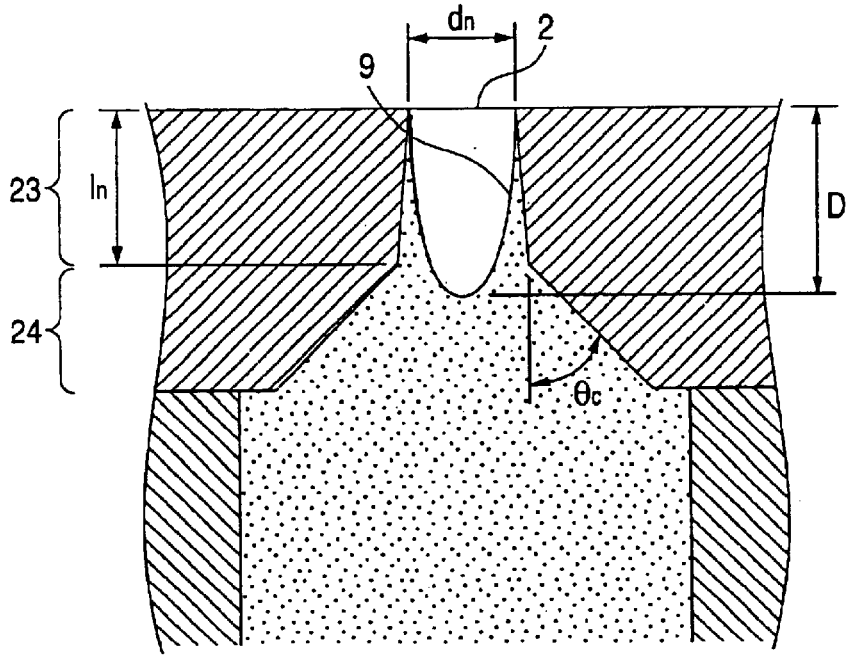
FIG. 14 is a view showing the nozzle shape according to a second embodiment of the invention.

FIG. 14 is a view showing the nozzle shape a droplet ejecting head according to a second embodiment of the invention. The structure other than the nozzle is made the same as that in the first embodiment. That is, the droplet ejecting head according to this embodiment has a feature in that the nozzle is constituted by combination of a straight portion 23 and a tapered portion 24.

With the nozzle configured thus, bubbles can be effectively prevented from being involved into the nozzle, so that it is possible to obtain a droplet ejecting head high in ejecting stability and reliability. That is, the invention has a problem that bubbles are apt to be involved into the nozzle because the meniscus is retracted by a distance substantially as long as the length of the nozzle straight portion 23. Particularly, when the nozzle is constituted only by a straight portion as in the first embodiment, a large step is formed in the lower end of the straight portion so that bubbles are apt to stay in the step portion and apt to be involved into the nozzle. The droplet ejecting head ejects a droplet due to a pressure wave generated in the pressure generating chamber. Therefore, when there are bubbles in the flow path, a normal pressure wave cannot be generated. Thus, the ejecting condition varies largely. Particularly, fine droplet ejection based on meniscus control is sensitive to the characteristic (amplitude and natural period) of the pressure wave so that it is highly likely that ejection becomes impossible when bubbles are involved.

Therefore, in this embodiment, the nozzle 2 is constituted by the straight portion 23 and the tapered portion 24 so as to prevent a step from occurring in the lower end of the straight portion 23. The shape of the tapered portion 24 is established to make the function of preventing bubbles from being involved compatible with the function of generating a velocity vector with a large R-component in the meniscus 9. The nozzle 2 in this embodiment is formed by perforating a stainless steel plate with a press. The nozzle aperture diameter $d_n$ is set at 20 $\mu$m, the length $l_n$ of the straight portion 23 is set at 25 $\mu$m, the length of the tapered portion 24 is set at 30 $\mu$m, and the taper angle $\theta_t$ of the tapered portion is set at about 45°.

As a result of an ejecting test using the droplet ejecting head according to this embodiment (using the driving waveform of FIG. 2), it is confirmed that there occurred no involved bubbles even if fine droplets of 1 pl are ejected continuously for one hour at a driving frequency of 10 kHz. On the other hand, when a similar ejecting test is performed upon the ink jet recording head according to the first embodiment, a failure in ejection caused by involved bubbles occurs in about 1% of nozzles. From this fact, it can be said that this embodiment in which each nozzle is constituted by a straight portion and a tapered portion is effective in improving the reliability of the droplet ejecting head.

Incidentally, it is optimum that the portion to be connected to the lower end of the straight portion has a tapered shape, but any shape other than the tapered shape may be applied if a velocity vector having a large R-component can be generated in the meniscus and the effect of preventing bubbles from being involved can be obtained.

From the point of view of making the function of preventing bubbles from being involved compatible with the function of generating a velocity vector with a large R-component in the tip of the meniscus 9, it is preferable that the taper angle $\theta_t$ of the tapered portion 24 is in a range of 30°–60°. However, even by use of a taper angle out of this range, the effect of the invention can be obtained though it is insufficient.

Figure 15:
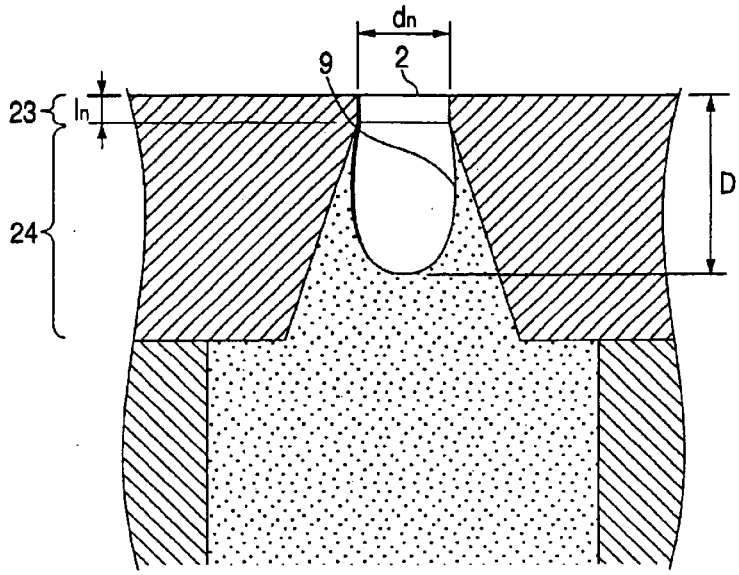
FIG. 15 is a view showing the nozzle shape in a droplet ejecting head in the related art.

Incidentally, a nozzle configuration based on the combination of a straight portion and a tapered portion has been known in the related art (for example, JP-A-Hei.10-226070). However, such a technique in the related art is completely different from the invention. That is, in the nozzle of the related art, the straight portion is provided to secure the accuracy of the nozzle aperture diameter or to improve the accuracy of the droplet ejecting direction, and the length of the straight portion is typically small to be about 10–20 $\mu$m. In addition, the taper angle of the tapered portion is also typically small to be not smaller than 20°. Therefore, when a fine droplet is ejected in the meniscus control system using the nozzle of the related art, it is extremely difficult to attain ultrafine droplet ejection (strong meniscus interference in the nozzle central portion) intended by the invention. When a fine droplet is ejected in the meniscus control system using the nozzle in the related art, the meniscus has to be retracted into the inside of the tapered portion as shown in FIG. 15 (because the straight portion is short). As a result, the curvature radius at the tip of the meniscus increases. In addition, the taper angle of the tapered portion is small so that it is difficult to obtain a large R-component in the velocity vector of the meniscus when "push" is applied. Practically, as a result of fine droplet ejection using the nozzle in the related art shown in FIG. 15, the fine droplet, which can be ejected, has a limit at 2 pl.

That is, the effect of the invention cannot be obtained only by the nozzle made of the straight portion and the tapered portion. The effect of the invention can be obtained only by setting the relationship between the length $l_n$ of the straight portion and the meniscus retraction quantity D optimally.

[Third Embodiment]

Figure 16:
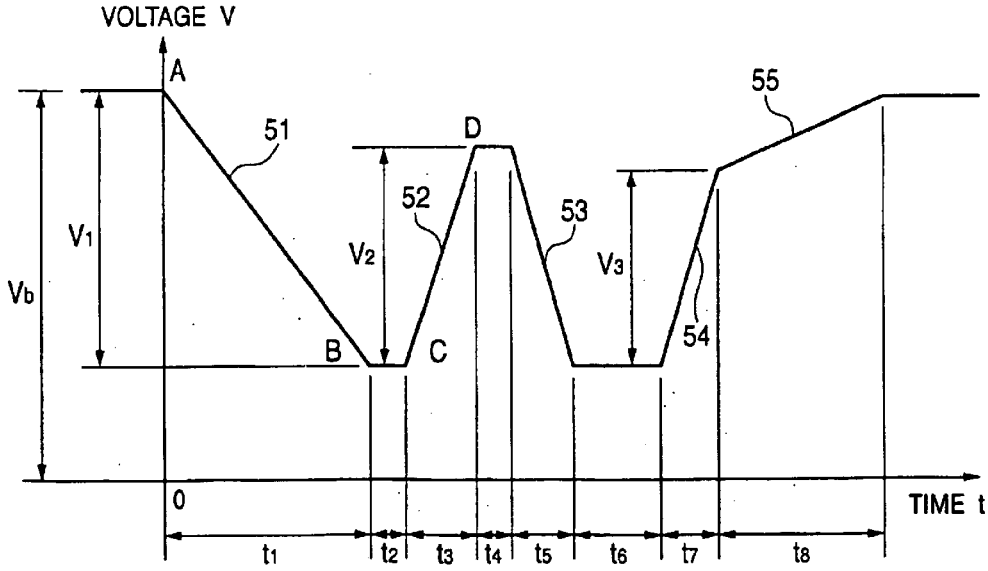
FIG. 16 is a graph showing a driving waveform according to a third embodiment of the invention.

FIG. 16 shows a driving waveform in a droplet ejecting head according to a third embodiment of the invention. This driving waveform is constituted by a first voltage change process 51 for expanding the pressure generating chamber immediately before ejection, a second voltage change process 52 for compressing the pressure generating chamber at a sharp rate, a third voltage change process 53 for expanding the pressure generating chamber at a sharp rate, a fourth voltage change process 54 for compressing the pressure generating chamber again at a sharp rate, and a fifth voltage change process 55 for restoring the applied voltage to its reference voltage. That is, basic elements of this driving waveform are similar to those in the first embodiment. This driving waveform has a feature in that the voltage change time $t_1$ of the first voltage change process 51 is set to be substantially equal to ½ of the natural period $T_c(=2\pi/E_c)$, and the interval ($t_2$) between the completion time of the first voltage change process 51 and the start time of the second voltage change process 52 is set to be very small. This setting is done to generate a large particle acceleration in the meniscus when the second voltage change process 52 is applied. Thus, a fine droplet with a smaller droplet volume can be ejected, as will be described later.

Figure 17:
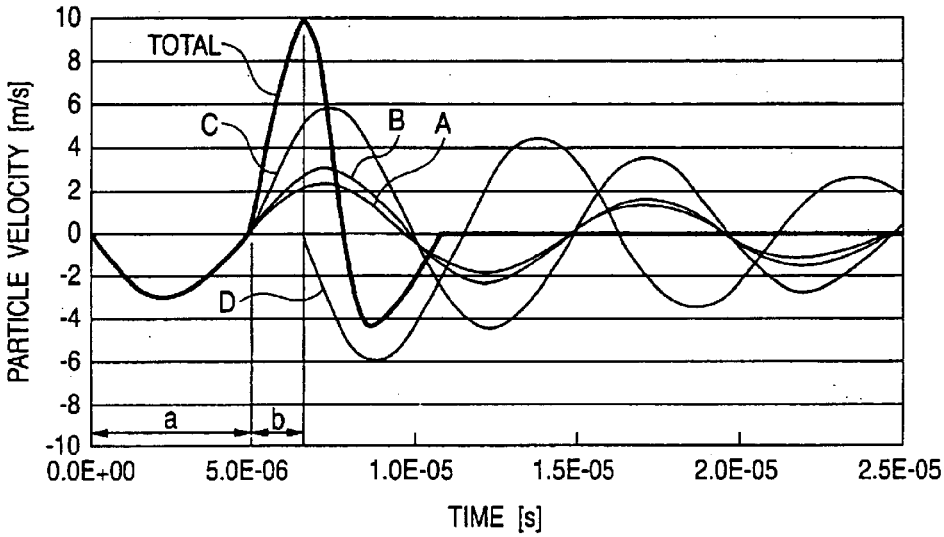
FIG. 17 is a graph showing the nozzle portion particle velocity in the third embodiment of the invention.

FIG. 17 shows a result of the particle velocity $v_3$ obtained using the expressions (2) for the driving waveform of FIG. 16 (taking only the vibration component of the expression (1) into consideration). In FIG. 17, the thin lines designate particle velocities generated in respective nodes A, B, C and D, and the thick line designates a particle velocity obtained by laying those particle velocities on one another, that is, an actual change of the particle velocity generated in the meniscus.

When the time $t_1$ is set at ½ of the natural period $T_c$ and the interval $t_2$ is set to be extremely small in the driving waveform, the phases of the particle velocity changes generated in the nodes A, B and C substantially match one another as shown in FIG. 17. Therefore, the amplitude of the particle velocity increases suddenly in the time range of $(t_1+t_2)\leqq t\leqq(t_1+t_2+t_3)$ (time range b in FIG. 17). Thus, there occurs a very sharp velocity change.

As described previously, since the velocity of the meniscus is increased in the liquid column forming step, more strong meniscus interference occurs in the nozzle central portion so that an extremely thin liquid column advantageous to fine droplet ejection can be formed. Accordingly, it is extremely advantageous to fine droplet ejection to make the phases of particle velocity changes generated in the nodes A, B and C substantially match one another and generate a large particle acceleration in a time range of $(t_1+t_2)\leqq t\leqq(t_1+t_2+t_3)$ as shown in FIG. 12A.

Since the natural period $T_c$ of the droplet ejecting head used in this embodiment is 10 $\mu$s, the voltage change time $t_1$ of the first voltage change process 51 is set at 5 $\mu$s, and the interval $t_2$ is set at 0.5 $\mu$s. Incidentally, in order to obtain the effect of the phase matching of the particle velocity, it is desired to set the interval $t_2$ to be not larger than ⅕ of the natural period $T_c$.

In addition, the voltage change quantity $V_1$ is set at 25 V to allow the meniscus retraction quantity D to satisfy the condition of $0.8\cdot l_n\leqq D\leqq 1.5\cdot l_n$. In addition, voltage change times are set at 2 $\mu$s in a section $t_3$, 0.5 $\mu$s in a section $t_4$, 2

μs in a section $t_5$, 0.3 μs in a section $t_6$, 2.2 μs in a section $t_7$, and 17 μs in a section $t_8$. On the other hand, voltage change quantities were set at 8 V in voltage change quantity $V_2$, 13 V in voltage change quantity $V_3$, and 20 V in bias voltage $V_b$.

As a result of an ejecting test using the droplet ejecting head according to this embodiment, a fine droplet having a droplet volume of 0.5 pl and a droplet velocity of 8.2 m/s can be ejected. In such a manner, the meniscus retraction quantity D is set to be optimal for the nozzle length $l_n$, while the phases of particle velocity changes generated in the nodes A, B and C of the driving waveform are made to match one another, so as to increase the particle acceleration of the meniscus at the time of "push". Thus, it is confirmed that a smaller fine droplet than that in the first embodiment can be ejected. That is, according to this embodiment, there are combined two means effective in fine droplet ejection, one of which is the optimization of the meniscus retraction quantity D while the other is the increase of the particle velocity at the time of "push".

[Fourth Embodiment]

Figure 18:
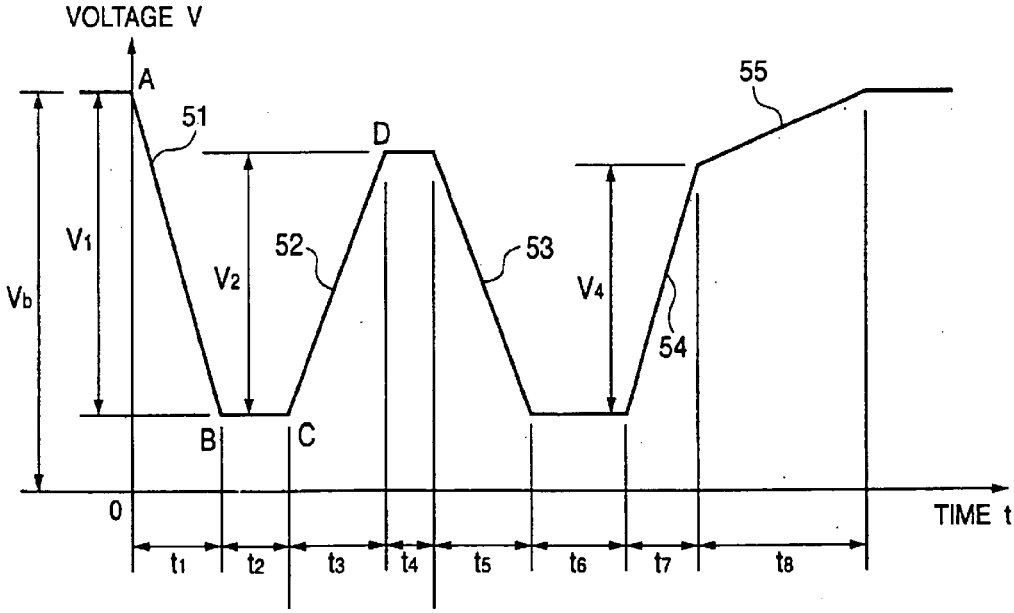
FIG. 18 is a graph showing a driving waveform according to a fourth embodiment of the invention.

FIG. 18 shows a driving waveform in a fourth embodiment of a droplet ejecting head according to the invention. This driving waveform is constituted by a first voltage change process 51 for expanding the pressure generating chamber immediately before ejection, a second voltage change process 52 for compressing the pressure generating chamber at a sharp rate, a third voltage change process 53 for expanding the pressure generating chamber at a sharp rate, a fourth voltage change process 54 for compressing the pressure generating chamber again at a sharp rate, and a fifth voltage change process 55 for restoring the applied voltage to its reference voltage. That is, basic elements of this driving waveform are also similar to those in the first embodiment and those in the second embodiment. This driving waveform has a feature in that the voltage change time $t_1$ of the first voltage change process 51 and the time interval ($t_2$) between the completion time of the first voltage change process 51 and the start time of the second voltage change process 52 are set to satisfy predetermined conditions. This setting is done to generate a large particle acceleration in the meniscus when the second voltage change process 52 is applied. Thus, a fine droplet with a smaller droplet volume can be ejected, as will be described below.

Figure 19:
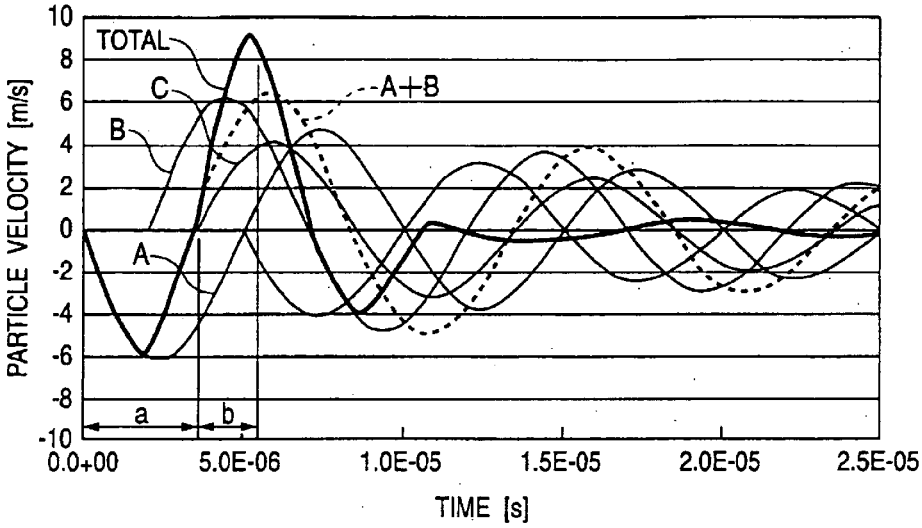
FIG. 19 is a graph showing the nozzle portion particle velocity in the fourth embodiment of the invention.

FIG. 19 shows a result of the particle velocity $v_3$ obtained using the expressions (2) for the driving waveform of FIG. 18 (taking only the vibrating component of the expression (1) into consideration). In FIG. 19, the thin lines designate particle velocities generated in respective nodes A, B, C and D, and the thick line designates a particle velocity obtained by laying those particle velocities on one another, that is, an actual change of the particle velocity generated in the meniscus.

From the expression (1), the vibrating components of particle velocities $v_A$, $v_B$ and $v_C$ generated in the nodes A, B and C can be expressed respectively by:

$$v_A = a_A \sin\left(\frac{2\pi}{T_c}\cdot t + \phi_A\right) = a_A \sin\left(\frac{2\pi}{T_c}\cdot t + \pi\right)(t > 0)$$

$$v_B = a_B \sin\left(\frac{2\pi}{T_c}\cdot t + \phi_B\right) = a_B \sin\left(\frac{2\pi}{T_c}\cdot t + \frac{2\pi}{T_c}\cdot t_1\right)(t > t_1)$$

-continued $$v_c = a_c \sin\left(\frac{2\pi}{T_c}\cdot t + \phi_c\right) = a_c \sin\left(\frac{2\pi}{T_c}\cdot t + \frac{2\pi}{T_c}\cdot (t_1 + t_2)\right)(t > t_1 + t_2)$$

Incidentally, the attenuation term of the expression (1) is regarded as negligible here because the attenuation of the particle velocity has a little influence. Here, $a_A$, $a_B$ and $a_C$ designate amplitudes of the respective particle velocities, having the relationship of $a_A = a_B$ (having the same angle change quantity in the driving waveform). In addition, $\phi_A$, $\phi_B$ and $\phi_C$ designate the phases of the respective particle velocity changes.

By superimposing sine waves, the particle velocity in $t_1 < t < (t_1 + t_2)$ is expressed by:

$$v_{A+B} = a_{A+B}\sin(E_C \cdot t + \phi_{A+B})$$

$$a_{A+B} = \sqrt{a_A^2 + a_B^2 + 2a_A a_B \cos(\phi_A - \phi_B)} = a_A\sqrt{2\{1 + \cos(\phi_A - \phi_B)\}}$$

$$\tan\phi_{A+B} = \frac{a_A \sin\phi_A + a_B \sin\phi_B}{a_A \cos\phi_A + a_B \cos\phi_B} = \frac{\sin(E_C \cdot t_1)}{\cos(E_C \cdot t_1) - 1}$$

In $t > (t_1 + t_2)$, a particle velocity generated in the node C is further superimposed on the particle velocity expressed by the above expression. At this time, the amplitude in $t > (t_1 + t_2)$ becomes a maximum when the phase $\phi_C$ of the particle velocity generated in the node C is in agreement with the phase $\phi_{A+B}$ of the above expression. That is, the particle velocity amplitude in $t < (t_1 + t_2)$ becomes a maximum when the interval $t_2$ is set to satisfy:

$$t_2 = \frac{T_C}{2\pi}\tan^{-1}\left[\frac{\sin\left(\frac{2\pi}{T_C}\cdot t_1\right)}{\cos\left(\frac{2\pi}{T_C}\cdot t_1\right) - 1}\right] - t_1 \quad (5)$$

Figure 20:
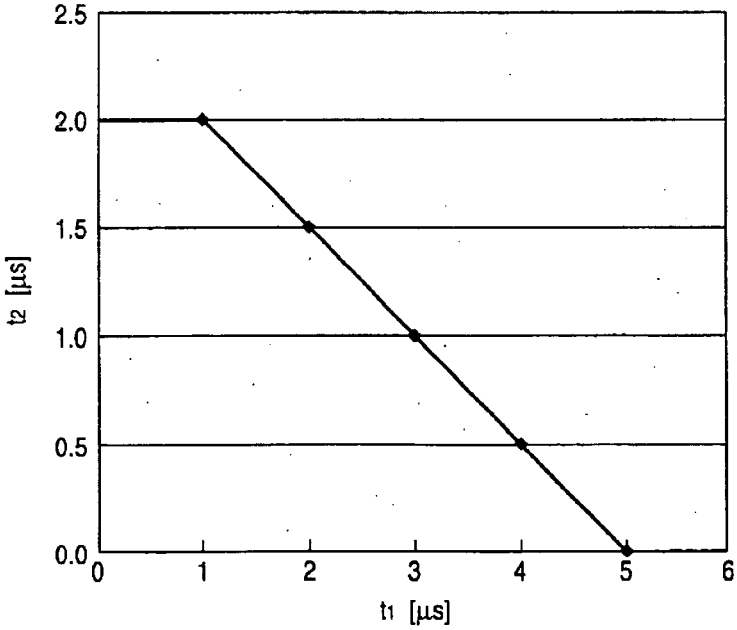
FIG. 20 is a graph showing an optimum value of $t_2$ corresponding to a value of $t_1$.

FIG. 20 shows a result of values of $t_2$ making the particle velocity amplitude a maximum, plotted on the basis of the expression (5) (calculated on the assumption of $T_c$=10 μs). It is understood that an optimum of $t_2$ exists in accordance with the set value of $t_1$.

As described above, when $t_1$ and $t_2$ are set in accordance with the expression (5), the amplitude of the particle velocity increases suddenly in the time range of $(t_1 + t_2) \leqq t \leqq (t_1 + t_2 + t_3)$ (time range b in FIG. 19), so that there occurs a very sharp velocity change, as shown in FIG. 19. Consequently, strong meniscus interference can be produced in the nozzle central portion advantageously to fine droplet ejection.

In this embodiment, $t_1$ and $t_2$ are set at 2 μs and 1.5 μs respectively to satisfy the condition of the expression (5). In addition, the voltage change quantity $V_1$ is set at 15 V to allow the meniscus retraction quantity D to satisfy the condition of $0.8 \cdot l_n \leqq D \leqq 1.5 \cdot l_n$. Voltage change times are set at 2 μs in a section $t_3$, 0.5 μs in a section $t_4$, 2 μs in a section $t_5$, 0.3 μs in a section $t_6$, 2.3 μs in a section $t_7$, and 8 μs in a section $t_8$. On the other hand, voltage change quantities are set at 10 V in voltage change quantity $V_2$, 13 V in voltage change quantity $V_3$, and 20 V in bias voltage $V_b$.

As a result of an ejecting test using the droplet ejecting head according to this embodiment, a fine droplet having a droplet volume of 0.6 pl and a droplet velocity of 8.0 m/s can be ejected.

[Fifth Embodiment]

Figure 21:
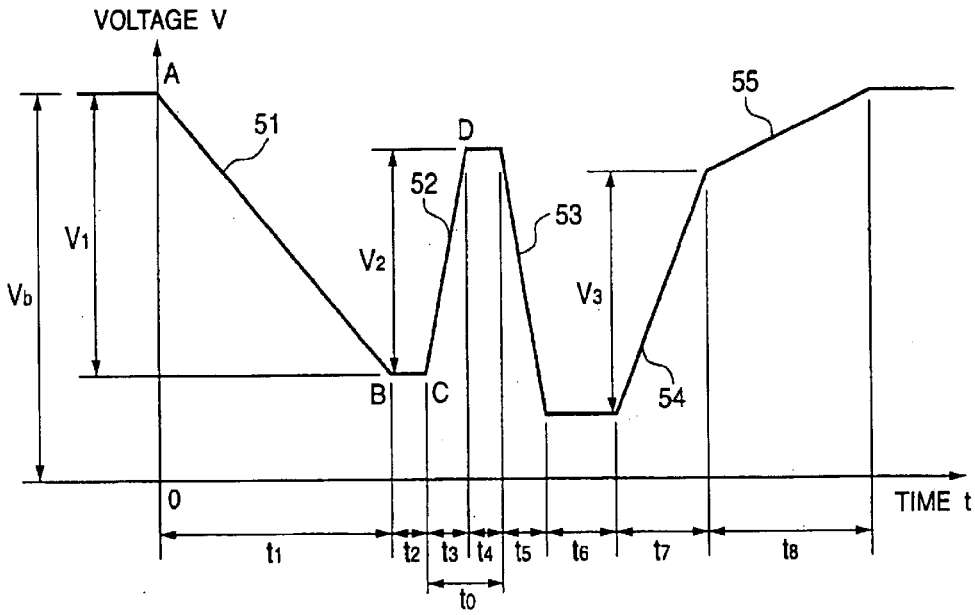
FIG. 21 is a graph showing a driving waveform according to a fifth embodiment of the invention.

FIG. 21 shows a driving waveform in a droplet ejecting head according to a fifth embodiment of the invention. This driving waveform is constituted by a first voltage change process 51 for expanding the pressure generating chamber immediately before ejection, a second voltage change process 52 for compressing the pressure generating chamber at a sharp rate, a third voltage change process 53 for expanding the pressure generating chamber at a sharp rate, a fourth voltage change process 54 for compressing the pressure generating chamber again at a sharp rate, and a fifth voltage change process 55 for restoring the applied voltage to its reference voltage. That is, basic elements of this driving waveform are also similar to those in the first to third embodiments. This driving waveform has a feature in that the voltage change time $t_3$ of the second voltage change process 52 and the voltage change time $t_5$ of the third voltage change process 53 are set to be smaller than the natural period $T_a$ of the piezoelectric actuator itself respectively. This setting is done to generate a large particle acceleration in the meniscus when the second voltage change process 52 is applied. Thus, a fine droplet with a smaller droplet volume can be ejected, as will be described later.

Here, the reason whey the driving waveform according to this embodiment is advantageous in ejecting a fine droplet with a small droplet volume will be described using an equivalent electric circuit model. The equivalent electric circuit of the droplet ejecting head is expressed by FIG. 11A as described previously. When a high-rigidity piezoelectric actuator (laminated piezoelectric actuator of a longitudinal vibration mode or the like) is used as the piezoelectric actuator, a vibrating system shown in FIG. 11B together with the vibrating system shown in FIG. 11C are included in the circuit of FIG. 11A. FIG. 11B shows the proper vibration of the piezoelectric actuator itself, and the natural period $T_a$ thereof is expressed by:

$$T_a=2\pi\sqrt{m_0c_0}$$

Incidentally, the natural period $T_a$, which is regarded as a natural period when a rod ranging from a fixed end to a free end vibrates longitudinally, can be obtained approximately from:

$$T_a = 4L\sqrt{\frac{\rho_p}{E_p}}$$

where L designates the length of the piezoelectric actuator, $\rho_p$ and $E_p$ designate the density and elastic modulus of the material of the piezoelectric actuator respectively.

In the droplet ejecting head according to this embodiment, the piezoelectric actuator is 1.1 mm in length L, $8.0\times10^3$ kg/m$^3$ in density $\rho_p$ and 68 GPa in elastic modulus $E_p$. Thus, the natural period $T_a$ of the piezoelectric actuator itself is 1.6 $\mu$s.

Figure 22A:
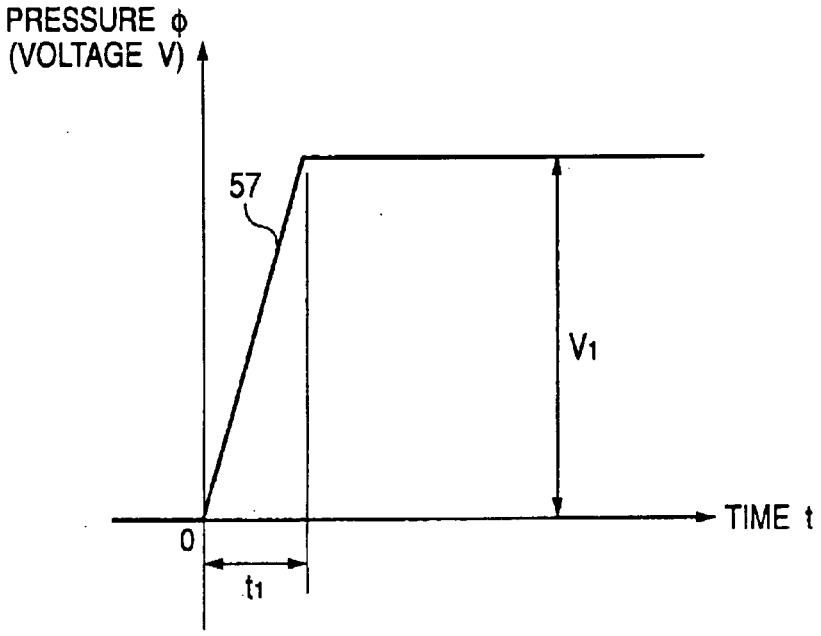
FIGS. 22A and 22B are first graphs for explaining the relationship between the driving waveform and the nozzle portion particle velocity.
Figure 23A:
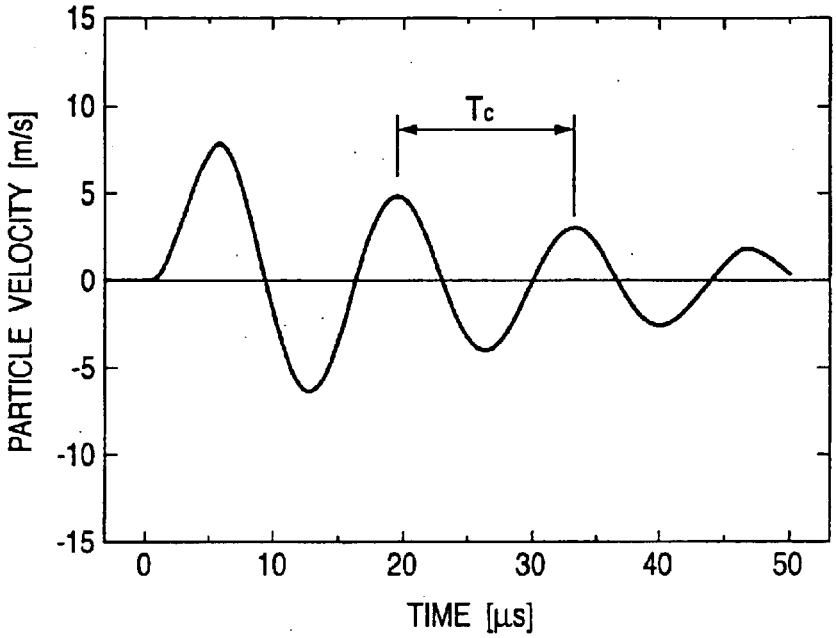
FIGS. 23A and 23B are second graphs for explaining the relationship between the driving waveform and the nozzle portion particle velocity.
Figure 23B:
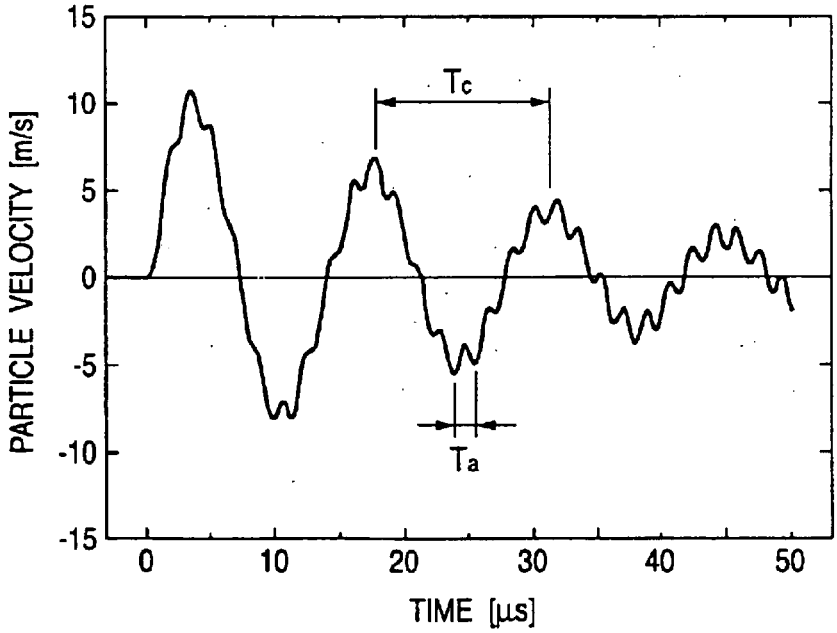

The proper vibration of the piezoelectric actuator itself can be excited by applying a specific driving waveform thereto. FIGS. 23A and 23B show a result of the change of the nozzle portion particle velocity $v_3$ obtained in the circuit of FIG. 11A when the pressure $\phi$ (proportional to the driving voltage) is varied as shown in FIG. 22A. When the rise time $t_1$ of the pressure $\phi$ is set to be larger than the natural period $T_a$, the particle velocity $v_3$ oscillates in the natural period $T_c$ as shown in FIG. 23A. That is, in this case, the particle velocity $v_3$ is dominated only by the circuit of FIG. 11C. This shows the pressure generating mode in the droplet ejecting head in the related art. On the other hand, when the rise time $t_1$ of the pressure $\phi$ is set to be not larger than the natural period $T_a$, the particle velocity $v_3$ changes as shown in FIG. 23B. In this case, the vibrating system of FIG. 11B is excited so that the oscillation of the natural period $T_c$ and the oscillation of the natural period $T_a$ have been consequently superimposed on each other in the change of the particle velocity $v_3$. That is, when the rise time $t_1$ of the pressure $\phi$ is set to be not larger than the natural period $T_a$, the meniscus can be vibrated in the natural period of the piezoelectric actuator itself.

Figure 22B:
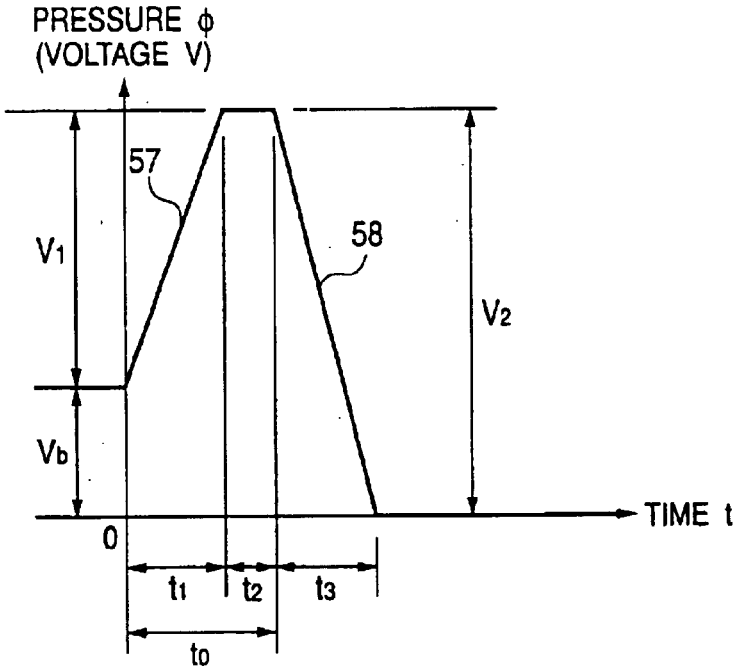
Figure 24:
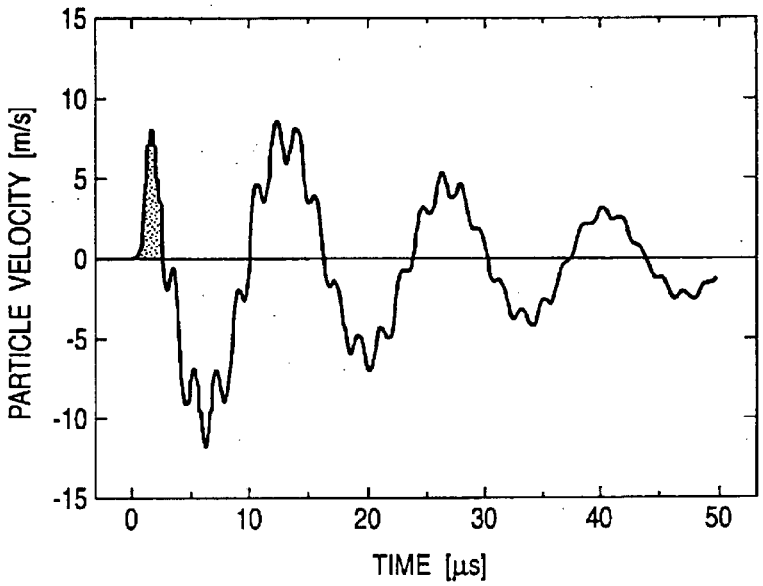
FIG. 24 is a third graph for explaining the relationship between the driving waveform and the nozzle portion particle velocity.

Next, consideration will be made on the case where the change of the pressure $\phi$ is shaped into a trapezoidal wave as shown in FIG. 22B. Here, when the rise time $t_1$ and the fall time $t_3$ are set to be not larger than the natural period $T_a$ respectively and the time difference ($t_0$) between the rise start time and the fall start time is set to satisfy $T_a/2 \leqq t_0 \leqq T_a$, the particle velocity $v_3$ of the meniscus changes as shown in FIG. 24. That is, the piezoelectric actuator extended suddenly by a rise portion 57 is applied with a voltage change 58 for contracting the piezoelectric actuator synchronously with the timing with which the piezoelectric actuator is to contract by its proper vibration. Thus, the piezoelectric actuator contracts suddenly so that the particle velocity $v_3$ consequently returns to $v_3=0$ at a very early timing.

By use of the operation, when the voltage change time $t_3$ of the second voltage change process 52 is set to be not larger than the natural period $T_a$, a great change can be produced in the meniscus velocity in the course of "push". In addition, when the voltage change time $t_5$ of the third voltage change process 53 is set to be not larger than the natural period $T_a$ and the time difference $t_0$ between the start time of the second voltage change process 52 and the start time of the third voltage change process 53 is set to be within the range of $T_a/2 \leqq t_0 \leqq T_a$, a droplet can be separated from a liquid column at an extremely early timing. Thus, it is possible to eject a droplet with an extremely small droplet volume. In the driving waveform of FIG. 21, $t_3$, $t_4$ and $t_5$ are set at 0.5 $\mu$s, 1 $\mu$s and 0.5 $\mu$s respectively to obtain such an operation. That is, although a droplet is ejected by use of only the circuit of FIG. 11C in the first to fourth embodiments, this embodiment has a significant feature in that a droplet is ejected also by use of the proper vibration of the driving portion (piezoelectric actuator) itself.

Figure 25:
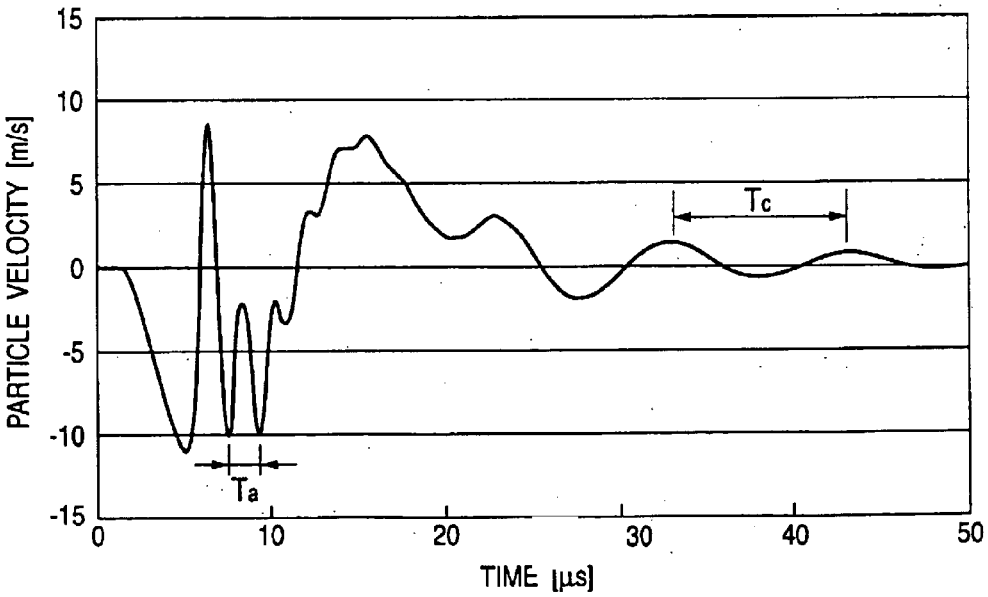
FIG. 25 is a graph showing the measurement result of the nozzle portion particle velocity in the fifth embodiment of the invention.

In addition, the fall time $t_1$ of the first voltage change process 51 is set at ½ (5 $\mu$s) of the natural period $T_c$ in order to match the phases of the particle velocity changes generated in the nodes A, B and C of the driving waveform with one another, and the time interval ($t_2$) between the first voltage change process 51 and the second voltage change process 52 is set at 0.2 $\mu$s to be small. In addition, the voltage change quantity $V_1$ is set at 20 V so as to allow the meniscus retraction quantity D to satisfy the condition of $0.8\cdot l_n \leqq D \leqq 1.5\cdot l_n$. FIG. 25 shows the result of observation of the behavior of the meniscus by a laser Doppler velocimeter when this driving waveform is applied thereto.

Practically, as a result of an ejecting test carried out using the driving waveform of FIG. 21, it is observed that a droplet having a droplet volume of 0.2 pl is ejected at a droplet velocity of 5.1 m/s. A smaller droplet than that in any one of the first to fourth embodiments can be ejected because the proper vibration of the piezoelectric actuator is used to increase the velocity change of the meniscus in the steps of liquid column formation and droplet separation. That is, according to this embodiment, there are combined two means effective in fine droplet ejection, one of which is the optimization of the meniscus retraction quantity D while the other is the increase of the meniscus particle velocity using the proper vibration of the piezoelectric actuator itself.

Incidentally, in order to attain stable ejection of a fine droplet, it is desired that the fall time $t_1$ of the first voltage change process 51 in the driving waveform is set to be in the range of $T_a < t_1 \leqq T_c$. This is because vibration of the natural period $T_a$ will occur also in the time range of $t \leqq t_1+t_2$ if the fall time $t_1$ is set to satisfy $t_1 \leqq T_a$. Thus, there is apt to arise a problem that accurate control of the meniscus shape becomes difficult or unnecessary ejection is caused. In addition, also in the setting of $t_1>T_c$, the change of the particle velocity $v_3$ in the time range of $t \leqq t_1+t_2$ becomes so complicated that accurate control of the meniscus shape becomes difficult. It is therefore desired to set $t_1$ in the range of $T_a<t_1 \leqq T_c$. In this case, as shown in FIG. 25, the meniscus shape can be controlled stably because there occurs no vibration of the natural period $T_a$ in the time range of $t \leqq t_1+t_2$.

[Sixth Embodiment]

Figure 26:
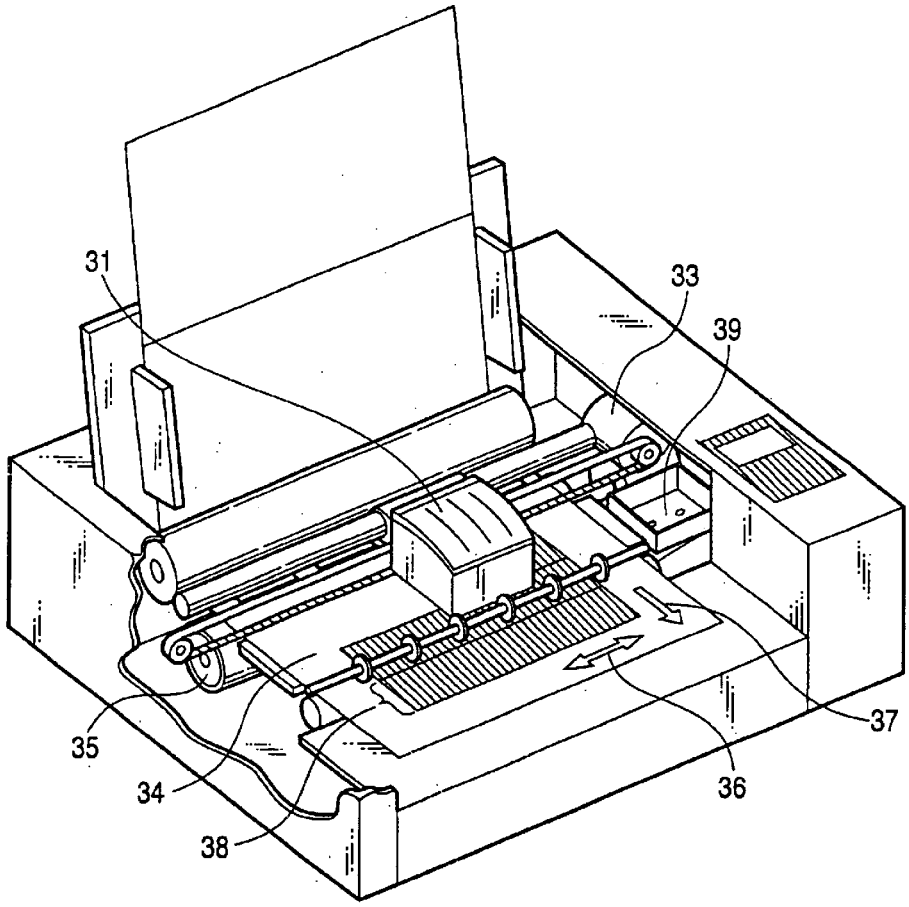
FIG. 26 is a view showing an embodiment of a droplet ejecting apparatus according to the invention.

FIG. 26 is a view showing a droplet ejecting apparatus according to a sixth embodiment of the invention. The droplet ejecting apparatus according to this embodiment is constituted by a carriage 31 mounted with droplet ejecting heads, a main-scanning mechanism 33 for conveying the carriage 31 to perform scanning in the main-scanning direction 36, and a sub-scanning mechanism 35 for conveying a sheet of recording paper 34 as a recording medium in the sub-scanning direction 37.

The droplet ejecting heads are mounted on the carriage 31 so that their nozzle surfaces face the sheet of recording paper 34. The droplet ejecting heads eject droplets onto the sheet of recording paper 34 while being conveyed in the main-scanning direction 36. Thus, the droplet ejecting heads perform recording on a fixed band area 38. Next, the sheet of recording paper 34 is conveyed in the sub-scanning direction 37, and the carriage 31 is conveyed again in the main-scanning direction 36. Thus, recording is performed on the next band area. Such an operation is repeated a plurality of times so that an image can be recorded on the whole surface of the sheet of recording paper 34.

Practically, images are recorded by use of the droplet ejecting apparatus according to this embodiment, and the image quality is evaluated. The head structure described in the fifth embodiment is adopted in each droplet ejecting head. The matrix-array heads corresponding to the four ink colors of yellow, magenta, cyan and black and having 260 ejectors for each color are arranged in parallel on the carriage 31. Dots of the four colors are superimposed on the sheet of recording paper 34. Thus, full-color images are recorded. As a result, an extremely high image quality with no granularity in any high-light portion, which is a low-density area, can be obtained because fine droplets of 0.5 pl are used.

Incidentally, this embodiment adopts the form in which recording is performed while the heads are conveyed by the carriage. However, the invention can be applied to other apparatus forms. For example, by use of linear heads in which nozzles are disposed all over the full width of a recording medium, recording can be performed with only the recording medium being conveyed while the heads are fixed.

In addition, this embodiment is applied to an image recording apparatus (printer) for recording an image on a sheet of recording paper by way of example. However, the invention is applicable not only to such an image recording apparatus but also a droplet ejecting apparatus for various industrial applications, for example, to eject an organic EL solution onto a substrate to thereby form an EL display panel or to eject molten solder onto a substrate to thereby form bumps for electric mounting.

Description has been made above on the embodiments of the invention. However, the embodiments show the preferred modes for carrying out the invention, and the invention is not limited to the embodiments. That is, various changes, improvements, modifications, simplifications, and the like, may be added to the embodiments so as to obtain other forms. Thus, the invention may be carried out by use of such other forms without departing from the scope and spirit of the invention.

For example, although piezoelectric actuators of a longitudinal vibration mode using a piezoelectric constant $d_{33}$ are used as piezoelectric actuators in the embodiments, actuators of other modes such as actuators of a longitudinal vibration mode using a piezoelectric constant $d_{31}$ may be used. In addition, although laminated piezoelectric actuators are used in the embodiments, a similar effect can be obtained in the case where actuators of a single plate type are used. Further, the invention is applicable to ink jet recording heads using electromechanical transducers other than piezoelectric actuators, for example, actuators using electrostatic force or magnetic force.

In addition, although the bias voltage (reference voltage) $V_b$ is set so that a voltage applied to the piezoelectric actuators is always positive in the embodiments, the bias voltage $V_b$ may be set to another voltage such as 0 V when there is no problem if a negative voltage is applied to the piezoelectric actuators.

Figure 6:
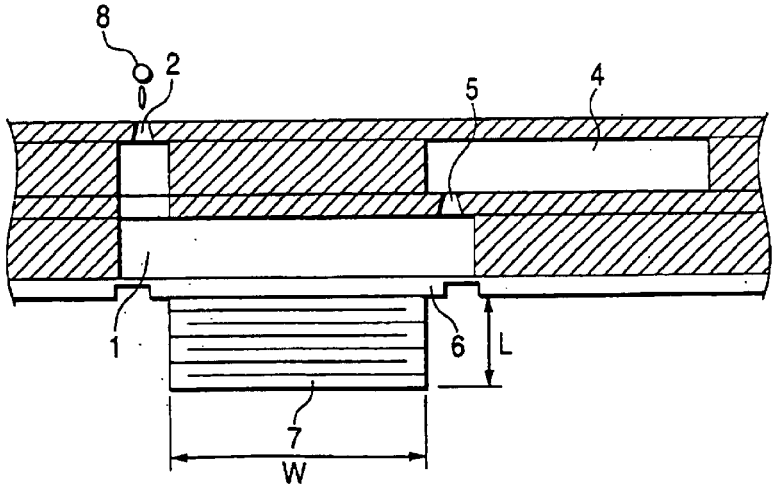
FIG.6 PRIOR ART
FIG. 6 is a sectional view showing the basic structure of a droplet ejecting head.
Figure 7A:
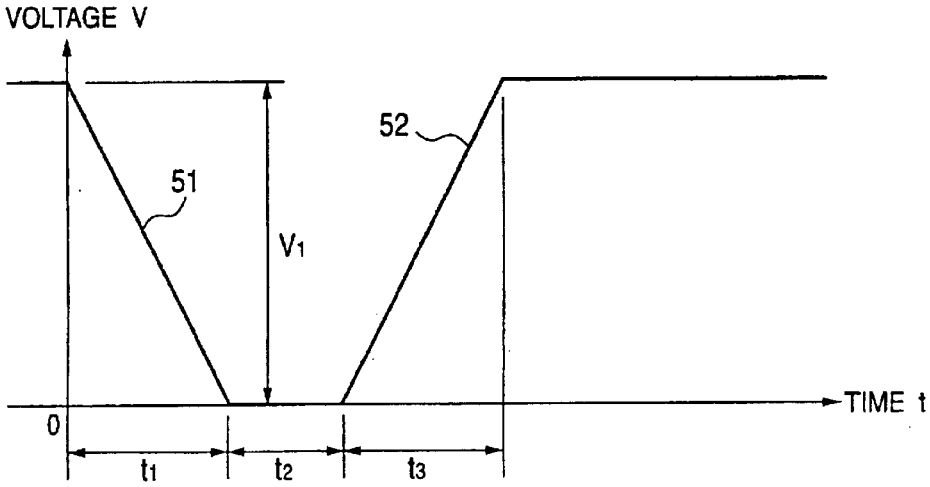
FIG.7A PRIOR ART
FIGS. 7A and 7B are graph showing driving waveforms for fine droplet ejection in the related art.
Figure 7B:
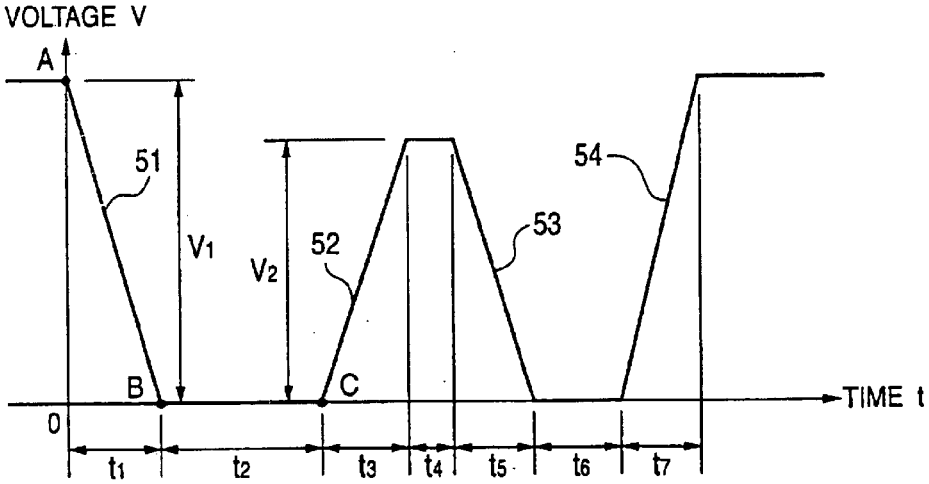
FIG.7B PRIOR ART
Figure 8A:
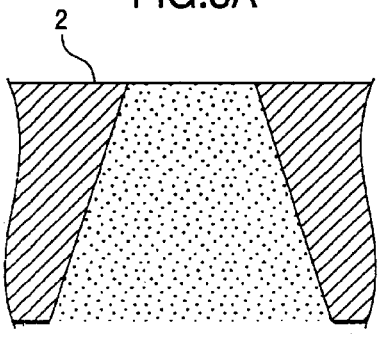
PRIOR ART FIG.8A
FIGS. 8A to 8D are schematic views for explaining the principle of fine droplet ejection.
Figure 8B:
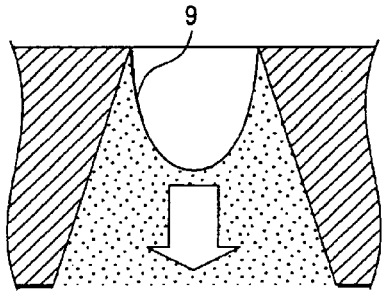
PRIOR ART FIG.8B
Figure 8C:
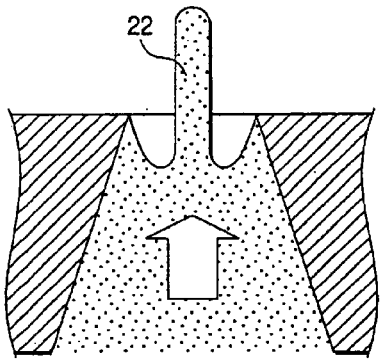
PRIOR ART FIG.8C
Figure 8D:
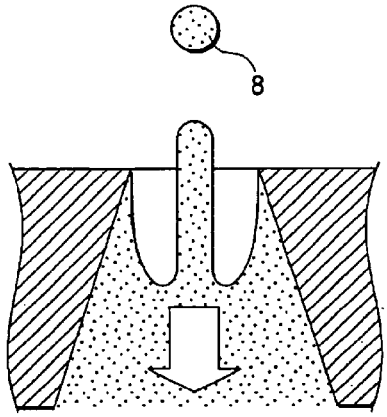
PRIOR ART FIG.8D
Figure 9A:
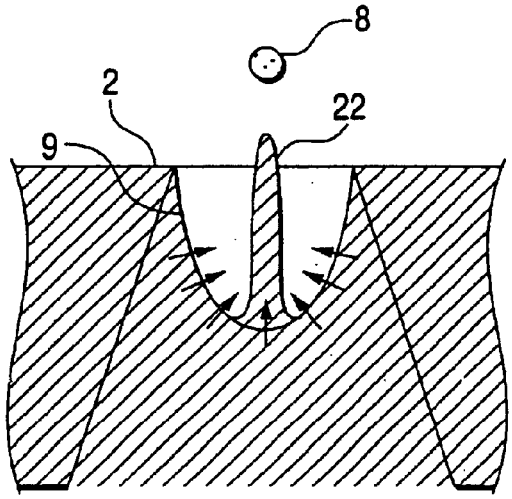
FIGS. 9A and 9B are schematic views for explaining the mechanism for forming a liquid column.
Figure 9B:
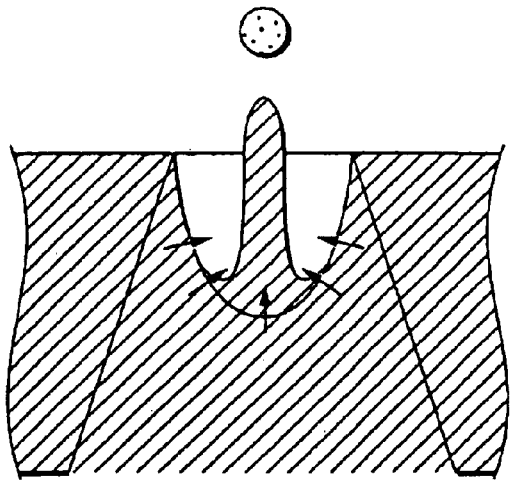

In addition, although a Kaiser type ink jet recording head as shown in FIG. 6 is used in the embodiments, the invention is likewise applicable to ink jet recording heads having other structures, for example, recording heads in which grooves provided in piezoelectric actuators are used as pressure generating chambers.

In addition, although the straight portion of the nozzle is formed into a tapered shape with a small taper angle in the embodiments, the straight portion of the nozzle in the invention is not always limited to a perfectly straight shape or a perfectly tapered shape. That is, the effect of the invention can be obtained also when the sectional shape of the straight portion is formed out of a curve or a plurality of straight lines if the apparent taper angle (approximated taper angle) is small.

In addition, although the nozzles are arrayed one-dimensionally in the embodiments, other nozzle arrangements may be used. For example, the nozzles may be arrayed two-dimensionally.

As has been described above, according to the invention, it is possible to attain ejection of a fine droplet of 1 pl or smaller, that has been difficult by a droplet ejecting apparatus in the related art. Thus, it is possible to attain ultra fine patterning in various fields of applications, such as recording of a high-quality image, formation of a high-density wiring pattern, or manufacturing of a high-resolution display panel.

In addition, according to the invention, it is possible to improve the stability of fine droplet ejection. Thus, it is possible to obtain a droplet ejecting apparatus high in reliability.

What is claimed is:

1. A method for driving a droplet ejecting head including:

a nozzle having a straight portion formed into a substantially straight shape with a small taper angle;

a pressure generating chamber communicating with the nozzle; and an electromechanical transducer, the method comprising the steps of:

applying a driving voltage to the electromechanical transducer;

deforming the electromechanical transducer;

producing pressure change in the pressure generating chamber filled with liquid; and ejecting a droplet from the nozzle, wherein a voltage waveform of the driving voltage includes:

a first voltage change process for expanding volume of the pressure generating chamber to retract a meniscus in the nozzle toward the pressure generating chamber; and a second voltage change process for compressing the volume of the pressure generating chamber to eject the droplet; and wherein voltage change quantity and voltage change time of the first voltage change process are set so that retraction quantity D of the meniscus at a time when the second voltage change process is applied satisfies:

$$0.8 \cdot l_n \leqq D \leqq 1.5 \cdot l_n$$

where $l_n$ designates length of the straight portion.

2. The method according to claim 1, wherein a voltage change time of the second voltage change process is set to be not larger than ⅓ of $T_c$, which designates a natural period of a pressure wave generated in the pressure generating chamber.

3. The method for driving a droplet ejecting head according to claim 1, wherein the voltage waveform of the driving voltage further includes a third voltage change process for expanding the volume of the pressure generating chamber immediately after the second voltage change process.

4. The method according to claim 3, wherein a voltage change time of the third voltage change process is set to be not larger than ⅓ of $T_c$, which designates a natural period of a pressure wave generated in the pressure generating chamber.

5. The method according to claim 3, wherein a time interval between a completion time of the second voltage change process and a start time of the third voltage change process is set to be not larger than ⅕ of the natural period $T_c$.

6. The method according to claim 3, wherein the voltage waveform of the driving voltage further includes a fourth voltage change process for compressing the volume of the pressure generating chamber immediately after the third voltage change process.

7. The method according to claim 6, wherein a voltage change time of the fourth voltage change process is set to be not larger than ½ of $T_c$, which designates a natural period of a pressure wave generated in the pressure generating chamber.

8. The method according to claim 3, wherein a voltage change time of the second voltage change process is set to be not larger than natural period $T_a$ of proper vibration of the electromechanical transducer.

9. The method according to claim 8, wherein a voltage change time of the third voltage change process is set to be not larger than the natural period $T_a$ of the proper vibration of the electromechanical transducer; and wherein a difference $t_0$ between a start time of the second voltage change process and a start time of the third voltage change process is set to satisfy:

$$T_a/2 \leqq t_0 \leqq T_a.$$

10. The method according to claim 1, wherein a voltage change time of the first voltage change process is set to be larger than a natural period $T_a$ of proper vibration of the electromechanical transducer and smaller than $T_c$, which designates a natural period of a pressure wave generated in the pressure generating chamber.

11. The method according to claim 1, wherein a voltage change time of the first voltage change process is set to be substantially equal to ½ of $T_c$, which designates a natural period of a pressure wave generated in the pressure generating chamber, and a start time of the second voltage change process is set to be immediately after the first voltage change process is completed.

12. The method according to claim 11, wherein a time interval between a completion time of the first voltage change process and a start time of the second voltage change process is set to be not larger than ⅕ of the natural period $T_c$.

13. The method according to claim 1, wherein a voltage change time $t_1$ of the first voltage change process and a time interval $t_2$ between a completion time of the first voltage change process and a start time of the second voltage change process are set to satisfy the following relational expressions:

$$t_2 = t_0 - t_1$$

$$t_0 = \frac{T_c}{2\pi}\tan^{-1}\left[\frac{\sin\left(\frac{2\pi}{T_C}\cdot t_1\right)}{\cos\left(\frac{2\pi}{T_C}\cdot t_1\right)-1}\right].$$

14. The method according to claim 1, wherein in the second voltage change process, the volume of the pressure generating chamber is compressed while a thin liquid column is formed from a central portion of the retracted meniscus.

15. A droplet ejecting head comprising:

a nozzle having a straight portion formed into a substantially straight shape with a small taper angle;

a pressure generating chamber communicating with the nozzle; and an electromechanical transducer, wherein a driving voltage is applied to the electromechanical transducer to generate pressure change in the pressure generating chamber and to eject a droplet from the nozzle;

wherein the driving voltage includes:

a first voltage change process for expanding volume of the pressure generating chamber to retract a meniscus in the nozzle toward the pressure generating chamber; and a second voltage change process for compressing the volume of the pressure generating chamber to eject the droplet;

wherein length $l_n$ of the straight portion is set to satisfy:

$$D/1.5 \leqq l_n \leqq D/0.8$$

where D designates a retraction quantity of the meniscus at a time when the second voltage change process is applied; and wherein the nozzle has a taper portion connected to the straight portion.

16. The droplet ejecting head according to claim 15, wherein the length $l_n$ of the straight portion is set to satisfy:

$$0.8 \cdot d_n \leqq l_n \leqq 2.0 \cdot d_n$$

where $d_n$ designates aperture diameter of the nozzle.

17. The droplet ejecting head according to claim 16, wherein the length $l_n$ is set to satisfy:

$$1.0 \cdot d_n \leqq l_n \leqq 1.6 \cdot d_n.$$

* * * * *